US009772579B2

(12) United States Patent
Oshikawa et al.

(10) Patent No.: US 9,772,579 B2
(45) Date of Patent: Sep. 26, 2017

(54) DEVELOPING DEVICE AND IMAGE FORMING APPARATUS INCORPORATING SAME

(71) Applicants: Yuki Oshikawa, Kanagawa (JP); Akira Azami, Kanagawa (JP); Yoshiko Ogawa, Tokyo (JP); Masaaki Yamada, Tokyo (JP); Yoshihiro Fujiwara, Kanagawa (JP); Noriyuki Kimura, Kanagawa (JP); Yoshiharu Kishi, Kanagwa (JP); Yasunobu Shimizu, Kanagawa (JP); Junichi Matsumoto, Kanagawa (JP); Yoshiyuki Fukuda, Tokyo (JP); Yuuji Ishikura, Kanagawa (JP); Kei Saito, Kanagawa (JP)

(72) Inventors: Yuki Oshikawa, Kanagawa (JP); Akira Azami, Kanagawa (JP); Yoshiko Ogawa, Tokyo (JP); Masaaki Yamada, Tokyo (JP); Yoshihiro Fujiwara, Kanagawa (JP); Noriyuki Kimura, Kanagawa (JP); Yoshiharu Kishi, Kanagwa (JP); Yasunobu Shimizu, Kanagawa (JP); Junichi Matsumoto, Kanagawa (JP); Yoshiyuki Fukuda, Tokyo (JP); Yuuji Ishikura, Kanagawa (JP); Kei Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/394,992

(22) Filed: Dec. 30, 2016

(65) Prior Publication Data

US 2017/0108795 A1 Apr. 20, 2017

Related U.S. Application Data

(62) Division of application No. 15/012,144, filed on Feb. 1, 2016.

(30) Foreign Application Priority Data

Feb. 13, 2015 (JP) ..... 2015-026782
Apr. 14, 2015 (JP) ..... 2015-082690
Dec. 25, 2015 (JP) ..... 2015-253824

(51) Int. Cl.
*G03G 15/08* (2006.01)

(52) U.S. Cl.
CPC ..... *G03G 15/0812* (2013.01)

(58) Field of Classification Search
None
See application file for complete search history.

(56) References Cited

U.S. PATENT DOCUMENTS 5,234,786 A 8/1993 Ueda
5,289,237 A 2/1994 Hashizume
(Continued)

FOREIGN PATENT DOCUMENTS

JP 08110704 A * 4/1996
JP 8-211745 8/1996
(Continued)

OTHER PUBLICATIONS

JP 08110704 A English machine translation, Ikeda et al., Apr. 30, 1996.*

*Primary Examiner* — Thomas Giampaolo, II
(74) *Attorney, Agent, or Firm* — Oblon, McClelland, Maier & Neustadt, L.L.P.

(57) ABSTRACT

A developing device includes a developer bearer disposed facing a latent image bearer in a developing range to transport developer by rotation, a support to support the developer bearer and including a holder mount, a rod-shaped developer regulator disposed facing a surface of the developer bearer across a gap, and a holder secured to the holder mount of the support to hold the rod-shaped developer
(Continued)

regulator. The rod-shaped developer regulator extends in an axial direction of the developer bearer.

4 Claims, 19 Drawing Sheets

(56) References Cited

U.S. PATENT DOCUMENTS

| | | | | |
|---|---|---|---|---|
| 2008/0124136 | A1 | 5/2008 | Oshikawa | |
| 2008/0317513 | A1 | 12/2008 | Sakagawa et al. | |
| 2009/0041508 | A1 | 2/2009 | Oshikawa et al. | |
| 2009/0245882 | A1 | 10/2009 | Ozeki et al. | |
| 2011/0081168 | A1 | 4/2011 | Kimura | |
| 2011/0150525 | A1 | 6/2011 | Fujiwara et al. | |
| 2011/0164892 | A1 | 7/2011 | Ogawa et al. | |
| 2011/0229207 | A1 | 9/2011 | Matsumoto et al. | |
| 2011/0229216 | A1* | 9/2011 | Iwamura ..... | G03G 15/0812 399/274 |
| 2012/0099906 | A1* | 4/2012 | Nishizawa ..... | G03G 15/0818 399/284 |
| 2013/0045029 | A1 | 2/2013 | Kimura et al. | |
| 2013/0071147 | A1 | 3/2013 | Ogawa et al. | |
| 2013/0071148 | A1 | 3/2013 | Ishikura et al. | |
| 2014/0270838 | A1 | 9/2014 | Yoshizawa et al. | |
| 2014/0356030 | A1 | 12/2014 | Fukuda et al. | |
| 2015/0177646 | A1 | 6/2015 | Yamada et al. | |
| 2015/0338824 | A1 | 11/2015 | Shimizu et al. | |
| 2015/0362861 | A1 | 12/2015 | Oshikawa et al. | |
| 2016/0238966 | A1* | 8/2016 | Oshikawa ..... | G03G 15/0812 |

FOREIGN PATENT DOCUMENTS

| | | |
|---|---|---|
| JP | 9-050181 | 2/1997 |
| JP | 2010-015120 | 1/2010 |

* cited by examiner

DEVELOPING DEVICE AND IMAGE FORMING APPARATUS INCORPORATING SAME

CROSS-REFERENCE TO RELATED APPLICATIONS

This patent application is a divisional application of U.S. Ser. No. 15/012,144 filed Feb. 1, 2016, which is based on and claims priority pursuant to 35 U.S.C. §119(a) to Japanese Patent Application Nos. 2015-026782 filed on Feb. 13, 2015, 2015-082690 filed on Apr. 14, 2015, and 2015-253824 filed on Dec. 25, 2015, in the Japan Patent Office, the entire disclosure of each of which is hereby incorporated by reference herein.

BACKGROUND

Technical Field

Embodiments of the present invention generally relate to a developing device and an image forming apparatus, such as a copier, a printer, a facsimile machine, or a multifunction peripheral having at least two of copying, printing, facsimile transmission, plotting, and scanning capabilities, that includes the developing device.

Description of the Related Art

There are developing devices that include a rod-shaped developer regulator, instead of a flat developer regulator such as a doctor blade. The developer regulator is disposed facing a surface of a developer bearer with a clearance (i.e., a doctor gap secured therebetween to adjust the amount of developer transported to a developing range facing an image bearer such as a photoconductor.

SUMMARY

An embodiment of the present invention provides a developing device that includes a developer bearer disposed facing a latent image bearer in a developing range to transport developer by rotation, a support to support the developer bearer and including, a holder mount, a rod-shaped developer regulator disposed facing a surface of the developer bearer across a gap, and a holder secured to the holder mount of the support to hold the rod-shaped developer regulator. The rod-shaped developer regulator extends in an axial direction of the developer bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 5A, 5B, and 5C are exploded perspective views of the developing device, illustrating a doctor rod and a structure to support the doctor rod according to an embodiment;

DETAILED DESCRIPTION

Figure 1:
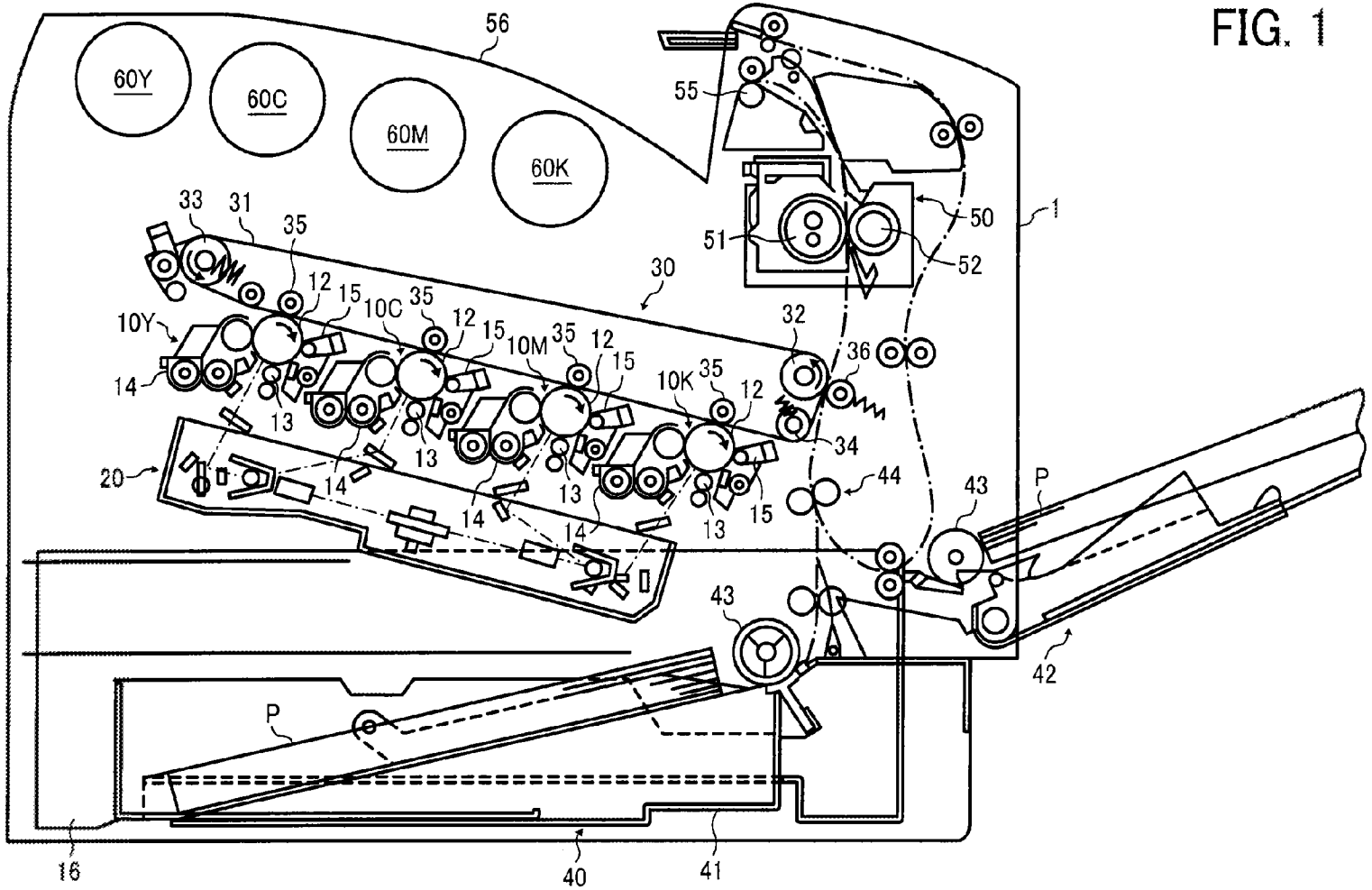
FIG. 1 is a schematic diagram illustrating an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each, specific element includes all technical equivalents that operate in a similar manner and achieve a similar result.

Referring now to the drawings, wherein like reference numerals designate identical or corresponding parts throughout the several views thereof, and particularly to FIG. 1, an electrophotographic printer as an image forming apparatus according to an embodiment of the present invention is described.

FIG. 1 is a schematic diagram of an image forming apparatus according to the present embodiment, which is a multicolor laser printer, for example.

It is to be noted that reference characters Y, M, C, and K represent yellow, magenta, cyan, and black, respectively, and may be omitted in the description below when color discrimination is not necessary.

An image forming apparatus 100 includes image forming units 10Y, 10C, 10M, and 10K, serving as process cartridges respectively corresponding to four different colors, removably mounted in image forming stations of an apparatus body 1. The process cartridges have a similar configuration except that the color of toner used therein is different and are replaced when their operational lives expire. The image forming apparatus 100 further includes an optical device 20 serving as an exposure device to emit laser beams, an intermediate transfer unit 30, a sheet feeder 40, and a fixing device 50.

The image forming units 10Y, 10C, 10M, and 10K are similar in structure. Each of the image forming units 10Y, 10C, 10M, and 10K includes a photoconductor drum 12 (12Y, 12C, 12M, or 12K) serving as a latent image bearer, a charging device 13 (13Y, 13C, 13M, and 13K) to charge the photoconductor drum 12, and a cleaning device 15 (15Y, 15C, 15M, or 15K) to remove untransferred toner from the photoconductor drum 12. To the image forming unit 10, a developing device 14 (14Y, 14C, 14M, or 14K) to develop a latent image on the photoconductor drum 12 is coupled.

The intermediate transfer unit 30 includes an intermediate transfer belt 31, rollers 32, 33, and 34 to rotatably support the intermediate transfer belt 31, primary transfer rollers 35 (35Y, 35C, 35M, and 35K) to primarily transfer toner images from the respective photoconductor drums 12 onto the intermediate transfer belt 31, and a secondary transfer roller 36 to secondarily transfer the toner image from the intermediate transfer belt 31 onto a sheet P (i.e., a recording medium). The sheet feeder 40 includes sheet feeding rollers 43 to transport the sheets P from a sheet feeding tray 41 and a bypass feeding tray 42, respectively, registration rollers 44, and the like. The fixing device 50 includes a fixing roller 51 and a pressure roller 52 and fixes the toner image on the sheet P with heat and pressure.

Toner bottles 60 (60Y, 60C, 60M, and 60K) disposed above the apparatus body 1 contain yellow, cyan, magenta, and black toners respectively supplied to toner supply inlets 145 (illustrated in FIG. 2) described later. Mounting and removal of the toner bottles 60 in and from the apparatus body 1 are independent of the image forming units 10Y, 10C, 10M, and 10K.

In such a configuration, initially, in the image forming unit 10Y for yellow, the charging device 13Y uniformly charges the photoconductor drum 12Y, the optical device 20 emits the laser beam onto the photoconductor drum 12Y, thus forming an electrostatic latent image, and then the developing device 14Y develops the electrostatic latent image into a toner image. The yellow toner image is primarily transferred from the photoconductor drum 12Y onto the intermediate transfer belt 31 with effects of the primary transfer roller 35Y (i.e., primary transfer process). After the toner image is transferred therefrom, the photoconductor drum 12Y is cleaned, by the cleaning device 15Y and prepared for subsequent image formation. The toner (i.e., waste toner) removed by the cleaning device 15Y is stored in a waste toner bottle extending in a direction in which the image forming unit 10Y is removed (i.e., a rotation shaft direction of the photoconductor drum 12). The waste-toner bottle is removably mounted in the apparatus body 1 and replaced when filled to capacity with the waste toner.

Similar image forming process is performed in each of the image forming units 10C, 10M, and 10K to form cyan, magenta, and black toner images sequentially. The toner image is transferred from the photoconductor drum 12 and superimposed on the toner image transferred previously on the intermediate transfer belt 31. Meanwhile, the sheet P is transported from the sheet feeding tray 41 or the bypass feeding tray 42 to a secondary transfer area, and the toner image is transferred from the intermediate transfer belt 31 onto the sheet P with effects of the secondary transfer roller 36. The sheet P on which the toner image is formed is transported to the fixing device 50. Where the toner image on the sheet P is fixed while the sheet P is nipped between the fixing roller 51 and the pressure roller 52. Then, a sheet election roller 55 discharges the sheet P onto an output tray 56.

The configuration of the image forming unit according to the present embodiment is described below.

Since the image forming units 10 have a similar configuration except the color of toner used therein, as an example, the configuration of the image forming unit 10Y for yellow is described.

Figure 2:
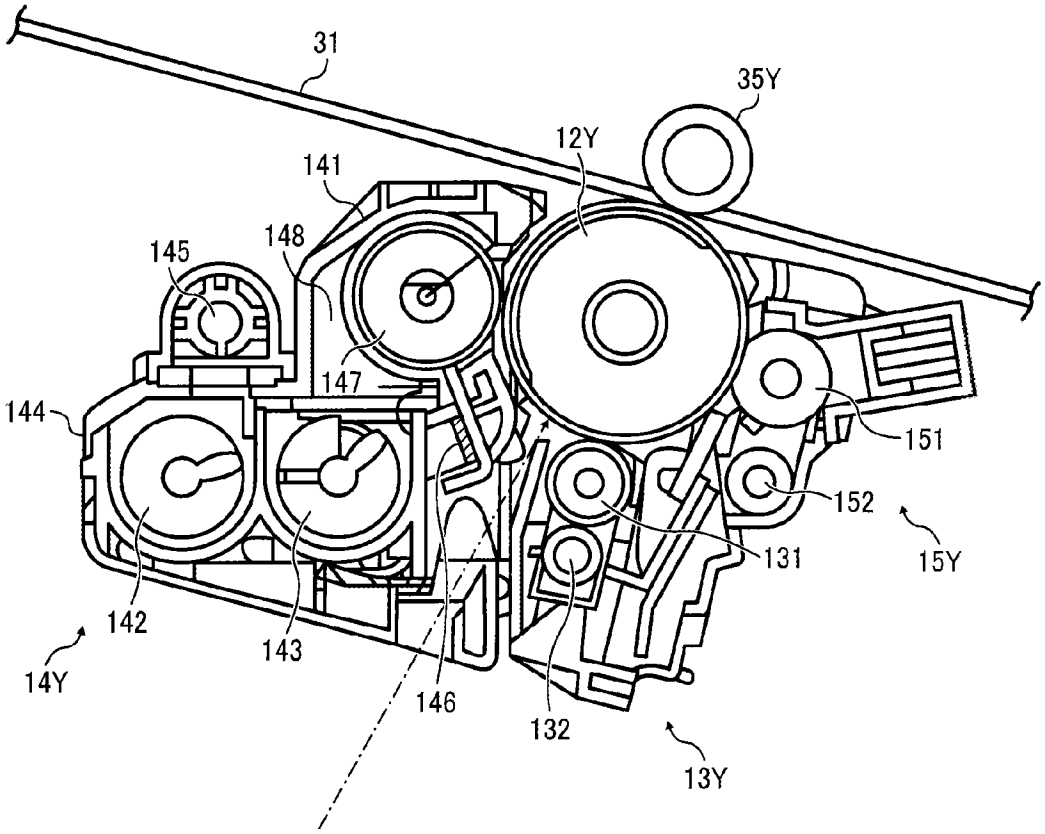
FIG. 2 is an end-on axial view of an image forming unit included in the image forming apparatus illustrated in FIG. 1.

FIG. 2 is a schematic view illustrating the image forming unit 10Y to form yellow toner images.

The charging device 13Y of the image forming unit 10Y includes a charging roller 131 and a cleaning roller 132 to clean a surface of the charging roller 131. The cleaning device 15Y includes a cleaning brush 151 to contact the surface of the photoconductor drum 12Y, a cleaning blade 152, and a toner collecting coil through which the toner removed by the cleaning brush 151 and, the cleaning blade 152 is transported to the waste-toner bottle.

The developing device 14Y includes a nonmagnetic developing sleeve 141 that is a hollow component. The developing sleeve 141 transports two-component developer including toner and magnetic carrier (hereinafter simply "developer") to a developing range facing the photoconductor drum 12Y. The developing sleeve 141 rotates counterclockwise in FIG. 2 (in the direction indicated by arrow Y1 in FIG. 9). A stationary magnet roller 147, serving as a magnetic field generator having multiple magnetic poles, is disposed inside the developing sleeve 141. The developing sleeve 141 and the magnet roller 147 together serve as the developer bearer.

Additionally, a doctor rod 146 shaped like a round rod is disposed facing the developing sleeve 141 to secure a doctor gap DG between the surface of the developing sleeve 141 and the doctor rod 146. The doctor gap DG is for regulating the amount (layer thickness) of developer carried on the surface of the developing sleeve 141. The developing device 14Y includes two conveying screws 142 and 143 serving as developer conveyors to reciprocate the developer inside the developing device 14Y in the axial direction of the photoconductor drum 12Y white stirring the magnetic carrier with the toner supplied from the toner supply inlet 145. The developer conveyors are not limited to screws but can be augers, coils, and paddles. These components are housed in and supported by a developing device casing 144.

The doctor rod 146 is shaped like a rod extending in a direction perpendicular to the direction in which the developer passes through the doctor gap DG. That is, the doctor rod 146 extends in the axial, direction of the developing sleeve 141. The doctor rod 146 is circular in cross section. The doctor rod 146 can be either a hollow cylinder or a solid columnar member without a hollow. Although the doctor rod 146 having a circular cross section is used in the present embodiment, the cross-sectional shape is not limited to a perfect circle but includes oval, eccentric circle, and regular polygon, for example.

Compared with plate shaped developer regulators (doctor blades), rod-shaped developer regulators such as the doctor rod 146 bend (deform) easily. For example, there is a risk that the doctor rod 146 deforms to widen the doctor gap DG due to the pressure of the developer borne on the developing sleeve 141 passing through, the doctor gap DG while the developing device 14 operates. Additionally, the doctor, rod 146 can sag under its own weight. Additionally, since the doctor rod 146 in the present embodiment is magnetic, the magnetic force that attracts a magnetic pole N2 of the magnet roller 147 and is attracted thereby acts on the doctor rod 146. It is possible that the magnetic force bends the doctor rod 146. Accordingly, it is preferred that the doctor rod 146 have a rigidity to resist deformation caused by such force.

Figure 6:
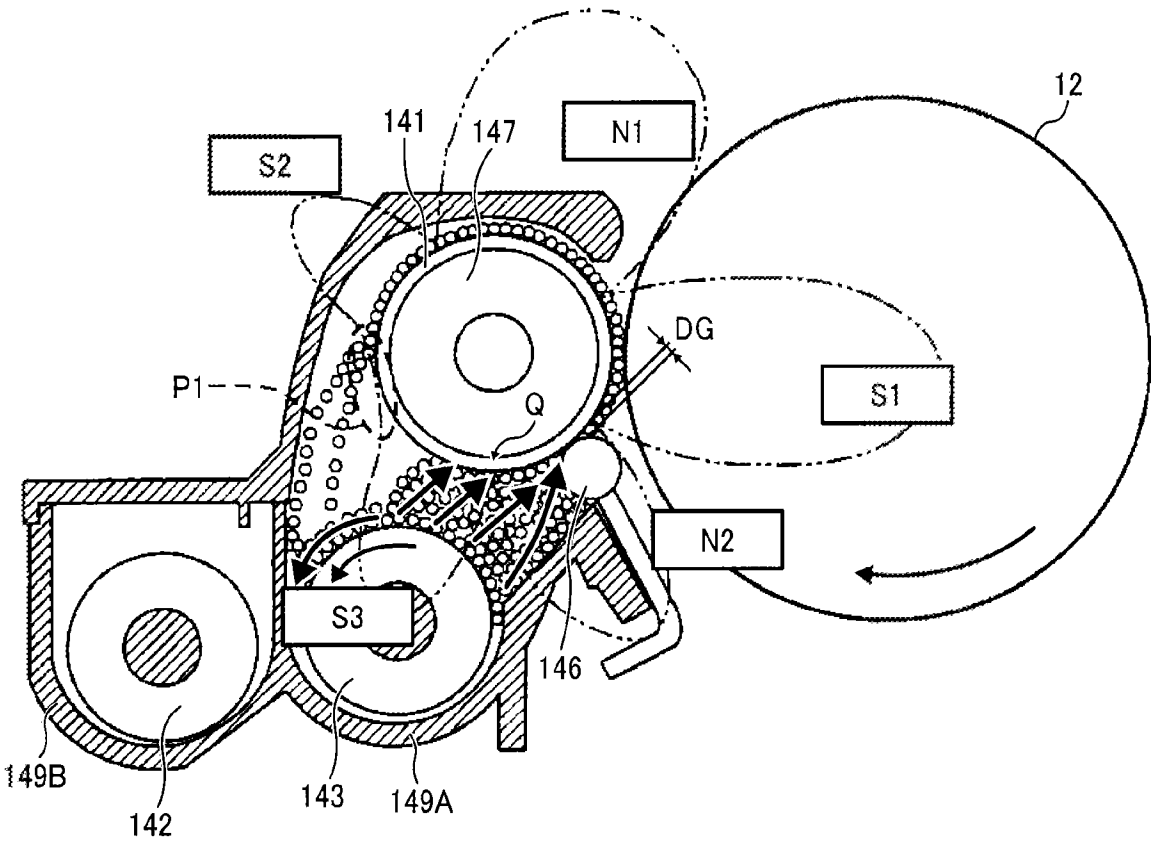
FIG. 6 is a schematic cross-sectional view of the developing device illustrated in FIG. 5, together with distribution of magnetic flux density (in absolute value) in a direction normal to the surface of the developing sleeve.

The doctor rod 146 is disposed in a narrow space between the photoconductor drum 12 and the developing sleeve 141 as illustrated in FIG. 6. If the doctor rod 146 has a large diameter, it is possible that the doctor rod 146 interferes with the photoconductor drum 12 or blocks the laser beam from the optical device 20. To prevent such inconveniences while securing the rigidity against deformation, the diameter of the doctor rod 146 is preferably in a range from 4 mm to 7 mm, for example.

Additionally, in the present embodiment, it is preferable to use toner having a volume average particle diameter within a range from 3 μm to 8 μm to attain fine dots of 600 dpi or greater. Advantageously, the ratio of the volume average particle diameter (Dv) to the number average particle diameter (Du) is within a range of from 1.00 to 1.40 (Dv/Dn). As the ratio (Dv/Dn) approaches 1.00, the particle diameter; distribution becomes narrower. In the case of toner having such a small diameter and a narrow particle diameter distribution, the distribution of electrical charge can be uniform, and thus high-quality image can be produced, with scattering of toner, in the backgrounds reduced. Further, in electrostatic transfer methods, the transfer ratio can be improved.

The magnetic carrier usable in the present embodiment has a weight average particle diameter in a range from 20 μm to 65 μm. If the weight average particle diameter is smaller than 20 μm, particle uniformity is degraded, thereby increasing the risk of adhesion of carrier. By contrast, if the weight average particle diameter exceeds 60 μm, the capability to reproduce images in detail is degraded, and it becomes difficult to produce fine images. The average panicle size of carrier can be measured by a particle size analyzer, Microtrac SRA manufactured by NIKKISO CO., LTD for example. The measured range may be from 0.7 μm to 125 μm. At that time, methanol is used for the solvent of the liquid dispersion, the refractive index is set to 1.33, and the refractive index for the carrier and a core material is set to 2.42.

Additionally, it is preferable that the carrier has a magnetization strength in a range from 40 ($A \cdot m^2/kg$) to 90 ($A \cdot m^2/kg$) under a magnetic field of $1\times10^6/4\pi$ (A/m) (1k[Oe]). With this setting, the retention between carrier particles is kept properly, thereby facilitating dispersion of toner in either magnetic carrier or developer. If the magnetization strength under the magnetic field of $1\times10^6/4\pi$ (A/m) is less than 40 ($A \cdot m^2/kg$), the possibility of adhesion of carrier increases, if the magnetization strength under the magnetic field of $1\times10^6/4\pi$ (A/m) is greater than 90 ($A \cdot m^2/kg$), the magnetic brush formed during image developing stiffens. Then, the reproducibility of image details is degraded, and it is difficult to produce fine images.

The magnetization strength can be measured as follows. Put 10 g of carrier particles in a cylindrical sell having an inner diameter of 7 mm and a height of 10 mm, and set the cell in a B-H tracer, BHU-60 (manufactured by Riken Denshi Co., Ltd.). Gradually increase the strength of magnetic field to $3\times10^6/4\pi$ [A/m] (3k[Oe]), and gradually decrease the strength to zero [A/m]. Then gradually increase the strength of magnetic field in the opposite direction to $3\times10^6/4\pi$ [A/m] (3k[Oe]). Farther, gradually decrease the strength of magnetic field to zero [A/m], and generate a magnetic field in the initial direction. Draw a B-H curve (magnetization curve) in this manner, and calculate the magnetization strength under the magnetic field of $1\times10^6/4\pi$ [A/m] (1k[Oe]) based on the B-H curve.

The magnetic carrier according to the present embodiment includes a magnetic core coated with a resin film including a resin component and a charge controller. The resin component is produced by cross linkage between a thermoplastic resin, such as acrylic resin, and a melamine resin. Use of the magnetic carrier can attain the following effects in a balanced manner. Impact can be absorbed to inhibit abrasion, and large particles can be kept with a strong adhesive force. Impact to the resin film is inhibited, and spent substances can be removed. Accordingly, the life of magnetic carrier is extended. That is, abrasion of film is inhibited, and spent carrier is reduced.

The configuration and operation of the developing device 14 are described in further detail below.

Figure 3:
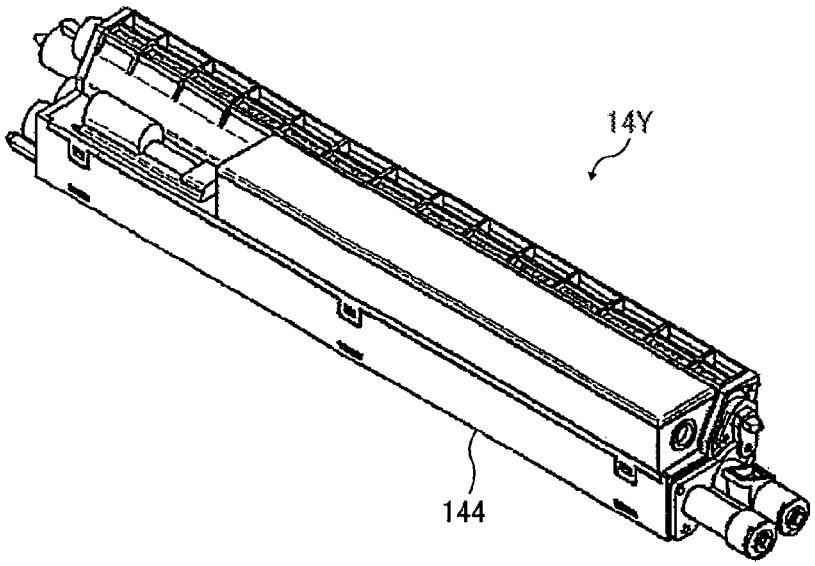
FIG. 3 is a perspective view of a developing device according to an embodiment.
Figure 4:
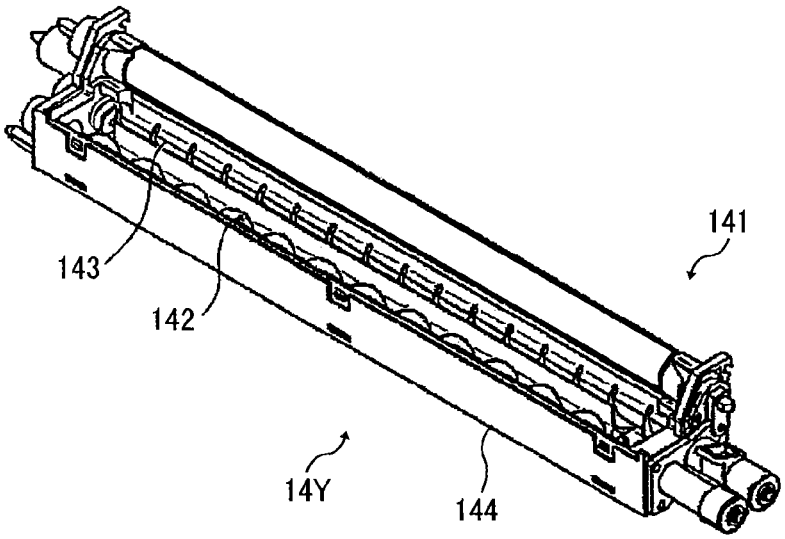
FIG. 4 is a perspective view of the developing device illustrated in FIG. 3, from which an upper casing is removed.
Figure 5:
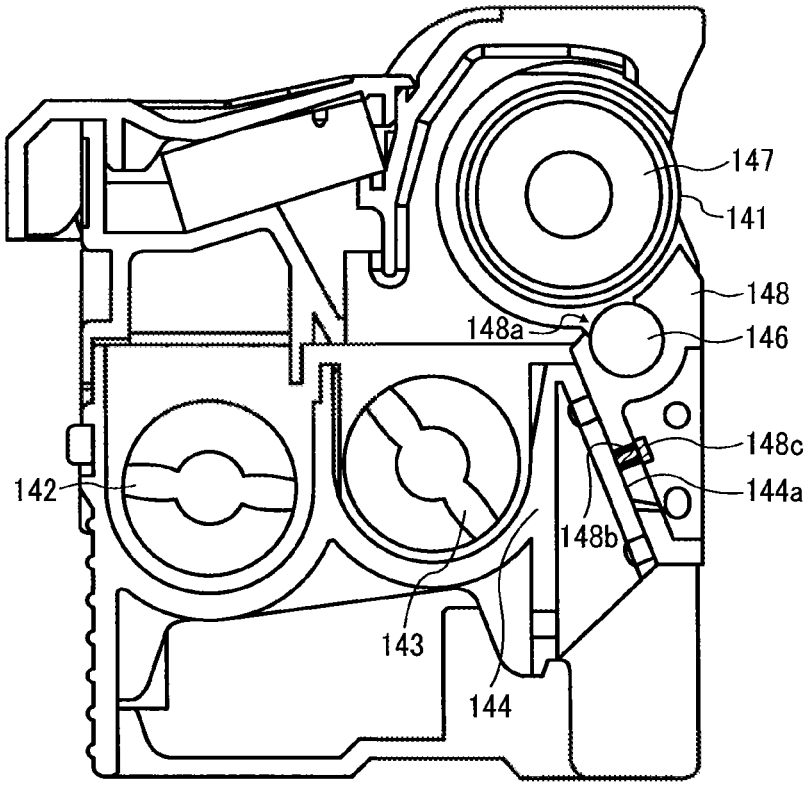
FIG. 5 is a cross-sectional view of the developing device illustrated in FIG. 3, along a plane perpendicular to an axial direction of a developing sleeve.

FIG. 3 is a perspective view illustrating an exterior of the developing device 14Y. FIG. 4 is a perspective view of the developing deice 14Y from which an upper casing is removed to illustrate an, interior of a developer container therein. FIG. 5 is a cross-sectional view of the developing device 14Y along a plane perpendicular to the axial direction of the developing sleeve 141. FIG. 6 is a schematic cross-sectional view of the developing device 14Y, together with distribution of magnetic flux density (in absolute value) in a direction normal to the surface of the developing sleeve 141, indicated by chain double-dashed lines.

The magnet roller 147 in the present embodiment includes a columnar body made of resin and magnetic powder, and the circumferential face is subjected to magnetization treatment to have multiple magnetic poles. The magnet roller 147 has a diameter of, for example, 18 mm in the present embodiment. In FIG. 6, the magnet roller 147 has a development pole S1 facing the photoconductor drum 12Y, a conveyance pole N1, an upstream release pole S2, a pole S3 (for releasing and scooping developer), and the regulation pole N2, which are disposed counterclockwise along the circumference of the developing sleeve 141 (i.e., the developer conveyance direction by the developing sleeve 141).

Although the magnet roller 147 in the present embodiment is produced by monolithic molding, alternatively, magnets separate for each pole can be arranged around the shaft. For the monolithic molding magnet roller, it is preferred that magnetic powder be dispersed in resin such as ethylene ethyl acrylate and nylon (registered trademark). For the magnetic powder, rare-earth magnets such as strontium ferrite, Nd—Fe—B based magnets, and Sm—Fe—N-based magnets are preferable.

By contrast, the developing sleeve 141 is a nonmagnetic hollow component. For the ease of processing, cost, and durability, aluminum, Steel Use Stainless (SUS), and the like are preferable as materials for the developing sleeve 141. It is more preferable that the outer circumferential face of the developing sleeve 141 has a number of oval recesses, for example, arranged at random. Recesses in the surface of the developing, sleeve 141, arranged at relatively large pitches, help the developer to follow the rotation of the developing sleeve 141, and thick brush bristles respectively rooted in the recesses can be generated. Further, the recesses do not easily abraded. Therefore, images quality is stable with image unevenness) inhibited for a long time. Such recesses are preferably formed by hitting a relatively large cut wire (a short piece of metal wire) on the base pipe of the developing sleeve like typical blasting. To facilitate conveyance of the developer, grooves or projections and recesses in irregular arrangement are often disposed on the surface of the developing sleeve (through sandblasting or bead-blasting). The developing sleeve having such protections and recesses is particularly common in multicolor image forming apparatuses to attain good image quality. Forming grooves on the developing sleeve or sandblasting the developing sleeve can prevent or reduce slippage of the developer on the surface of the developing sleeve and accumulation of the developer thereon, thus, preventing decreases in image density.

The developing device casing 144 defines the developer container inside the developing device 14Y. The developer container is partitioned into a supply compartment 149A and an agitation compartment 149B. The supply compartment 149A is disposed below the developing sleeve 141 and extending in the axial direction of the developing sleeve 141. The agitation compartment 149B is adjacent to the supply compartment 149A and extending in the axial direction of the developing sleeve 141. The conveying screws 142 and 143 are disposed in the supply compartment 149A and the agitation compartment 149B, respectively. The developer transported by the conveying screw 143 to the downstream end of the supply compartment 149A (distal side in FIGS. 5 and 6) is forwarded to the agitation compartment 149B, and then the conveying screw 142 transports the developer to the downstream end of the agitation compartment 149B (proximal side in FIGS. 5 and 6). From the downstream end of the agitation compartment 149B, the developer is forwarded to the supply compartment 149A and transported by the conveying screw 143 to the downstream end of the supply compartment 149A. Thus, the developer is circulated inside the developer container.

The toner is supplied to the developer in the agitation compartment 149B through the toner supply inlet 145 to compensate for the toner consumed in image development. While transported through the supply compartment 149A, the developer is scooped onto the developing sleeve 141 by the magnetic force (exerted by the pole S3 for releasing and scooping). After the doctor rod 146 regulates the amount of developer scooped on the developing sleeve 141, the developer passes through the developing range facing the photoconductor drum 12Y and returns to the developer container.

As the developing sleeve 141 rotates, the developer attracted on the developing sleeve 141 by the pole S3 is transported counterclockwise in FIGS. 5 and 6. After regulated by the doctor rod 146, the developer stands on end (in the form of magnetic brush) in the developing range due to the magnetic force by the development pole S1. Toner is supplied from the developer standing on end to the electrostatic latent image on the photoconductor drum 12Y. Downstream from the developing range, the developer is retained on the developing, sleeve 141 by the magnetic three by the conveyance pole N1 and the upstream release pole S2 and transported as the developing sleeve 141 rotates. Upon the repulsive magnetic force between the upstream release pole S2 and the pole S3 as well as the centrifugal force, the developer leaves the developing sleeve 141 and falls in the supply compartment 149A.

It is to be noted that the magnetic force can be calculated using a formula below.

$$Fr=G\times\{Hr\times(\partial Hr/\partial r)+Hr\times(\partial H\theta/\partial r)\}$$

$$F\theta=G\times\{1/r\times Hr\times(\partial Hr/\partial\theta)+1/r\times(Hr\times\partial H\theta/\partial\theta)\}$$

wherein "Fr" represents a magnetic Three component in the direction normal to the surface of the developing sleeve (hereinafter "normal direction magnetic force"), "Fθ" represents a magnetic force component in the direction tangential to the surface of the developing sleeve (hereinafter "tangential direction magnetic force"), "Hr" represents a magnetic flux density component in the direction normal to the surface of the developing sleeve (hereinafter "magnetic flux density in normal direction), and "Hθ" represents a magnetic flux density component in the direction tangential to the surface of the developing sleeve (hereinafter "tangential direction magnetic density). Further, "r" represents the calculation radius, and "G" is a constant ($7.8\times10^{-15}$).

In the description below, when the normal direction magnetic force Fr is a positive value, the magnetic force is in the direction to draw the magnetic carrier away from the developing sleeve 141. When the normal direction magnetic force Fr is a negative value, the magnetic three is in the direction to attract the magnetic carrier to the developing sleeve 141. Further, the terms "upstream" and "downstream" used below mean those w the direction in which the developer is transported.

The doctor rod 146 in the present embodiment is made of a magnetic material. The magnetic doctor rod 146 enhances the magnetic flux density between the regulation pole N2 of the magnet roller 147 and the doctor rod 146 inside the developing sleeve 141, and the magnetic flux density in normal direction in the doctor gap DG is high as illustrated in FIG. 6. This configuration reduces the amount of developer that passes through the doctor gap DG (i.e., the amount of developer transported to the developing range). It is conceivable that, as the magnetic flux density in normal direction in the doctor gap DG increases, the developer on the developing sleeve 141 is kept standing on end while passing through the doctor gap DG. Thus, the developer becomes, sparse. Also conceivable is that, as the magnetic force retaining the developer passing through the doctor, gap DG increases, the resistivity against conveyance of developer through the doctor gap DG increases. Consequently, the amount, of developer passing through the doctor gap DG decreases.

Reducing the amount of developer to pass through the doctor gap DG is advantageous in that the doctor gap DG can be wider relative to a target amount of developer to pass through the doctor gap DG (target amount of developer transported to the developing range). As the doctor gap DG becomes wider, fluctuations in the amount of developer that passes through the doctor gap DG corresponding to deviations of the doctor nap DG (distance from the developing sleeve 141 to the doctor rod 146) become smaller. Accordingly, use of the doctor rod 146 can suppress the fluctuation in the amount of developer transported to the developing range corresponding to the deviations of the doctor gap DG (differences in the distance from the developing sleeve 141 to the doctor rod 146). Additionally, as the doctor gap DG becomes wider, the possibility of clogging of the doctor gap DG with foreign substances becomes smaller. Thus, image failure such as white streaks resulting from the foreign substance stuck in the doctor gap DG can be inhibited.

Next, descriptions are given below of securing the doctor rod 146 to the developing device casing 144.

Figure 7:
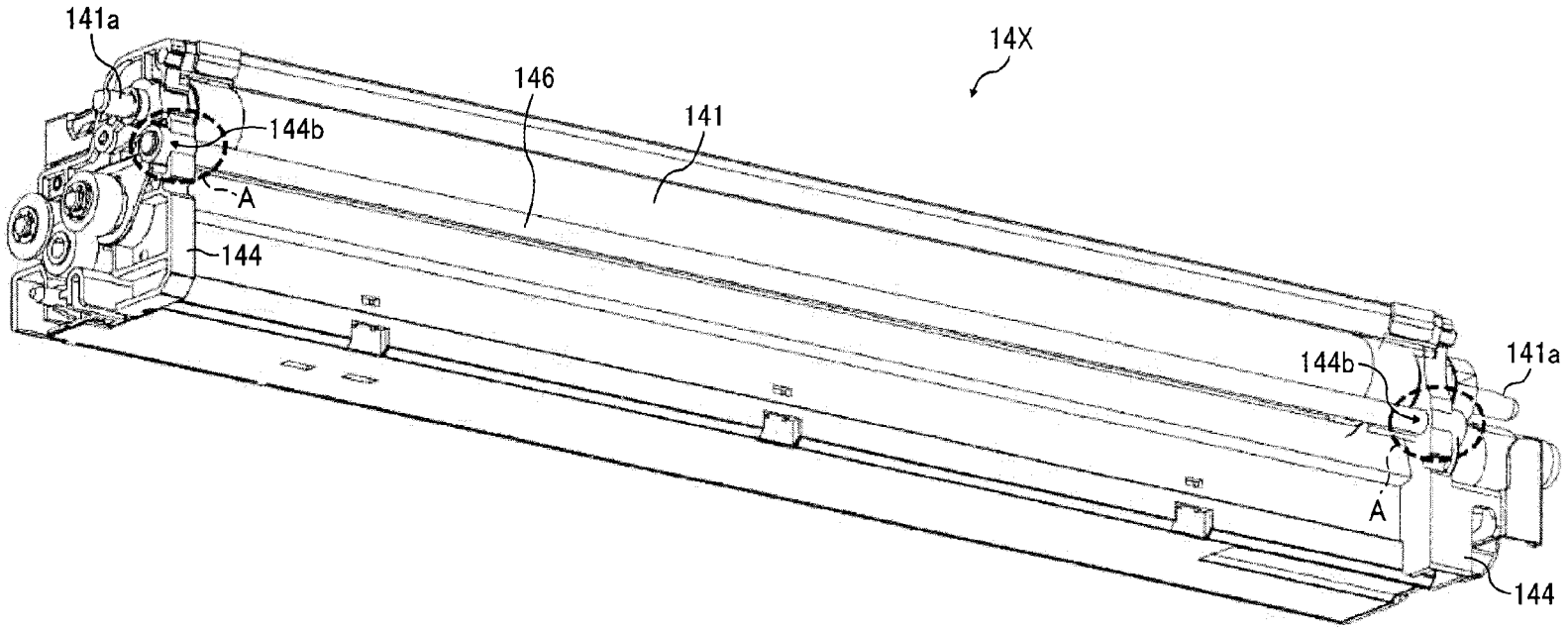
FIG. 7 is a perspective view of a developing device according to a comparative example, in which a developing device casing directly supports longitudinal ends of a doctor rod.

FIG. 7 is a perspective view of a developing device 14X according to a comparative example in which the developing device casing directly supports the longitudinal ends of the doctor rod 146.

In the comparative developing device 14X illustrated in FIG. 7, in areas A enclosed by broken circles in FIG. 7, both ends of the doctor rod 146 are directly supported by the insertion openings 144*b* cir the developing device casing 144 that supports a rotation shaft 141*a* of the developing sleeve 141. In the comparative example, the accuracy of the doctor gap DG depends on the positional accuracy of the insertion openings 144*b* of the developing device casing 144 that determine the positions of the ends of the doctor rod 146, respectively. The term "accuracy of the doctor gap DG" can be rephrased as the deviation of the doctor gap DG from a target doctor gap at different positions in the longitudinal direction of the doctor rod 146 (the axial direction of the developing sleeve). It is difficult to attain, precise positioning of the insertion openings 144*b* at low cost, and thus attaining a high accuracy of the doctor gap, at low cost is difficult in the comparative example.

By contrast, when the developer regulator is a plate-shaped doctor blade, the developer regulator has a certain length in the direction (short-side direction of the doctor blade) to approach and move away from the surface of the developing sleeve 141. Accordingly, the doctor blade itself can have slots to adjust the attachment position of the doctor blade to the developing device casing 144 in the direction to approach and move away from the surface of the developing sleeve 141. Such slots can be made at low cost. The doctor blade having the slots for adjustment can be screwed to the developing device casing 144, with the doctor gap DG adjusted within the length of the slots. For example, the doctor gap DG can be adjusted by inserting a thickness gauge between the developing sleeve 141 and the doctor blade, and then the doctor blade can be secured to the developing device casing 144. Thus, the doctor gap DG can be set with a high degree of accuracy.

Figure 8A:
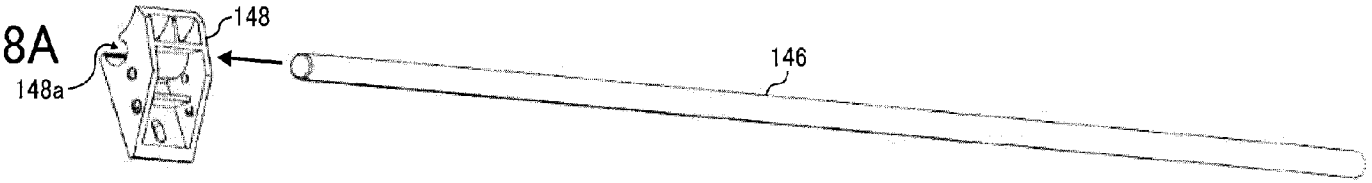
Figure 8B:
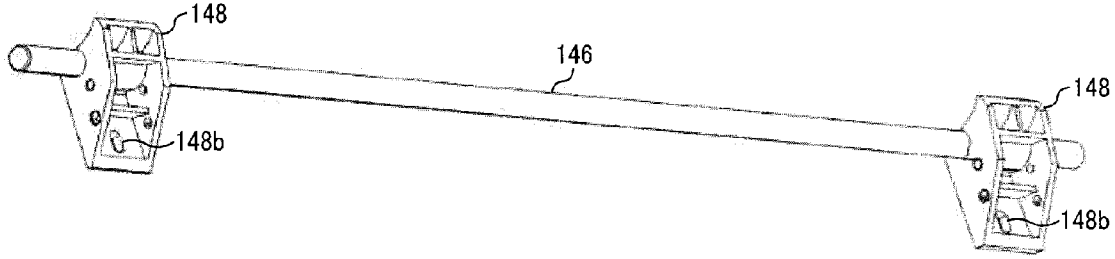
Figure 8C:
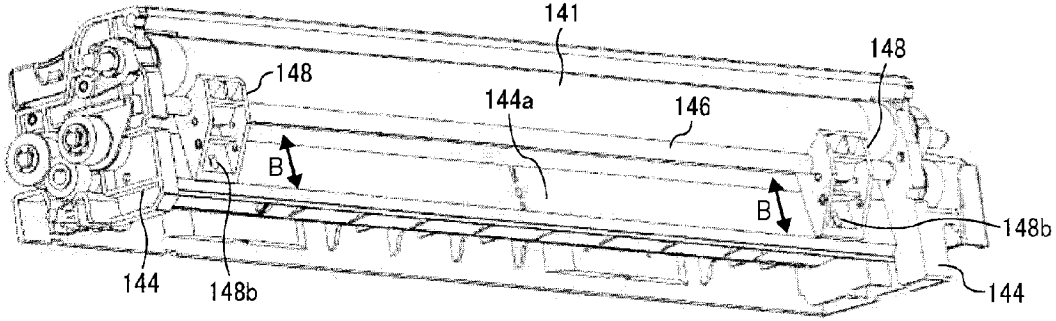

However, in the case of the rod-shaped developer regulator such as the doctor rod 146, it is difficult to form the slots for adjustment in the rod-shaped developer regulator at low cost. FIGS. 8A, 8B, and 8C are exploded perspective views of the developing device 14 according to the present embodiment.

In the present embodiment, the developing device 14 includes a doctor holder 148 to hold the doctor rod 146. The doctor rod 146 is secured to the developing device casing 144 via the doctor holder 148. To secure the doctor rod 146 to the developing device casing 144, as illustrated in FIG. 8A, initially, the doctor rod 146 is inserted into an insertion opening 148*a* of the doctor holder 148.

The insertion opening 148*a* is a through hole penetrating the doctor holder 148 in the longitudinal direction of the doctor rod 146, and a portion of the doctor holder 148 is cut out to expose a portion of the circumference of the doctor rod 146. The insertion opening 148*a* has a diameter slightly smaller than the diameter of the doctor rod 146, and the cutout is widened slightly when the doctor rod 146 is inserted into the insertion opening 148*a*. Then, as illustrated in FIG. 8B, the doctor holder 148 holds the doctor rod 146 with the insertion opening 148*a* covering a half or greater of the circumference of the doctor rod 146 (for example, about 270° in the present embodiment). In the configuration illustrated in FIGS. 8B and 8C, the developing device 14 includes two doctor holders 148, each of which supports the longitudinal end (or adjacent thereto) of the doctor rod 146. In FIG. 8C, arrows B indicates the direction in which the doctor rod 146 approaches and moves away from the surface of the developing sleeve 141 (hereinafter "approaching and parting direction B".

Figure 9:
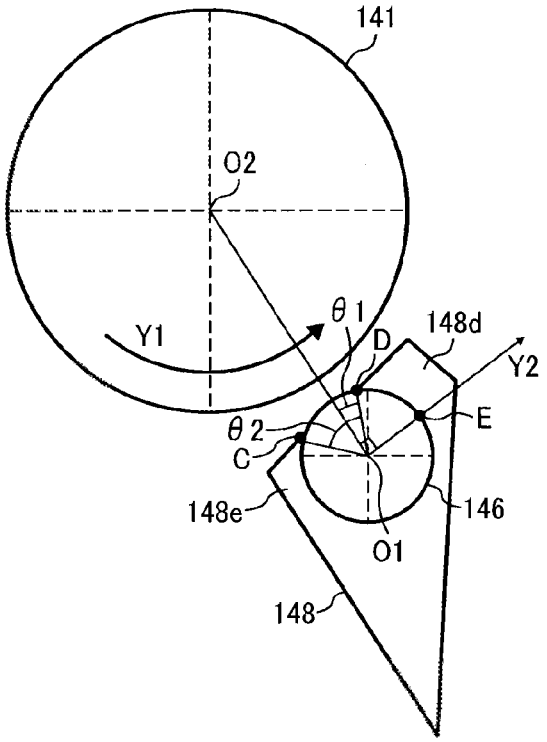
FIG. 9 is an end-on axial view of claws of the doctor holder to hold the doctor rod, perpendicular to the longitudinal direction of the doctor rod.

More specifically, as illustrated in FIG. 9, the doctor holder 148 includes a claw 148*d* (i.e., a downstream claw) and a claw 148*e* (i.e., an upstream claw) to pinch the doctor rod 146 from both sides in a direction, perpendicular to the longitudinal direction of the doctor rod 146 (perpendicular to the surface of the paper on which FIG. 9 is drawn). An end (at a point D) of the claw 148*d* is disengaged from an end (at a point C) of the claw 148*e*, and the clearance between the points C and D corresponds to the cutout of the doctor holder 148. Accordingly, the claws 148*d* and 148*e* pinch the doctor rod 146 not to cover an opposing portion (from the point C to the point D), out of the circumference of the doctor rod 146, facing the surface of the developing sleeve 141. That is, the points C and D where the ends of the claws 148*e* and 148*d* are disposed are outside the opposing portion where the doctor rod 146 faces the surface of the developing sleeve 141.

Of the two claws 148*d* and 148*e*, the claw 148*d* is positioned downstream from the opposing portion (from the point C to the point 13) in the direction indicated by arrow Y2 (i.e., passing direction), in which the developer passes through the doctor gap DG. On the cross section (illustrated in FIG. 9) perpendicular to the longitudinal direction of the doctor rod 146, the claw 148*d* on the downstream side is disposed to contact a point E, which is on the circumference of the doctor rod 146 and downstream from a center O1 (center of gravity) the doctor rod 146 in the passing direction indicated by arrow Y. That is, on the point E, the circumference of the doctor rod 146 crosses a segment extending from the center O1 of the doctor rod 146 in the passing, direction indicated by arrow Y2, which is parallel to the direction in which the developer passes through the doctor gap DG. In other words, on the cross section (the paper surface on which FIG. 9 is drawn) perpendicular to the longitudinal direction of the doctor rod 146, when O1-D represents a segment connecting the point D, where the end of the claw 148*d* contacts the doctor rod 146, and the center O1, and O1-O2 represents a segment connecting the center O1 of the doctor rod 146 and a center O2 of the developing sleeve 141 an angle θ1 between the segment O1-D and the segment O1-O2 is 90 degrees or smaller.

Figure 10:
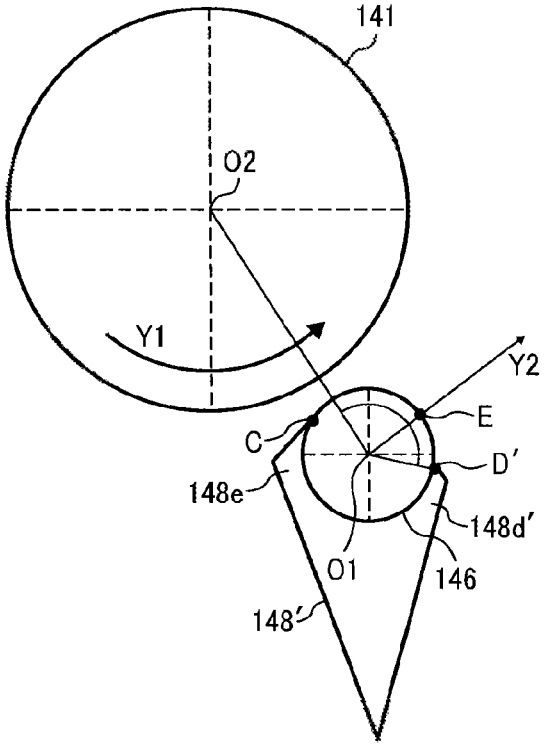
FIG. 10 is an end-on axial view of a doctor rod and a structure to support the doctor rod according to a comparative example, on a cross section perpendicular to the longitudinal direction of the doctor rod.

The doctor rod 146 receives, from the developer passing through the doctor gap DG, a pressing force to the downstream side in the passing direction indicated by arrow Y2, in which the developer passes through the doctor gap DG. FIG. 10 is a schematic cross-sectional view of a comparative doctor holder 148' based on an assumption that a downstream claw 148*d'* is not in contact with the point E on the circumference of the doctor rod 146 (the end of the downstream claw 148*d'* is at a point D'). In other words, the angle (Corresponding to the angle θ1 in FIG. 9) between a segment O1-D' and the segment O1 and O2 is greater than 90 degrees. In this case, the downstream claw 148*d*' of the doctor holder 148' fails to receive the pressing force given to the doctor rod 146 from the developer. In such a case, it is possible that the doctor rod 146 is moved by the pressing force of the developer, and changes in the pressing force caused by the developer cause fluctuations in the amount of developer to pass through the doctor gap DG (transported to the developing range).

By contrast, according to the present embodiment, the downstream claw 148*d* is in contact with the point. F on the circumference of the doctor rod 146, in other words, the angle θ1 is not greater than 90 degrees. Accordingly, the downstream claw 148*d* of the doctor holder 148 reliably receives the pressing force given to the doctor rod 146 from the developer. As a result, the doctor rod 146 is prevented from being moving by the pressing force from the developer, and the amount of developer to pass through the doctor gap DG (transported to the developing range) can be stable.

Additionally, in FIG. 9, θ2 represents a smallest angle between the points C and D fan the circumference of the doctor rod 146, to which the ends of the claws 148*d* and 148*e* respectively contact, as viewed from the center O1 (center of gravity) of the doctor rod 146 on the cross section (illustrated in FIG. 9, perpendicular to the longitudinal direction of the doctor rod 146. In the present embodiment, the angle θ2 is smaller than 180 degrees. In other words, on the cross section (illustrated in FIG. 9) perpendicular to the longitudinal direction of the doctor rod 146, the angle θ2 between a segment O1-C connecting the point C and the center O1 and the segment O1-D connecting the point D and the center O1 is smaller than 180 degrees.

With this configuration, even when an external force in the direction toward the developing sleeve 141 acts on the doctor rod 146, the claws 148*d* and 148*e* resist the external force and inhibit the doctor rod 146 from approaching the developing sleeve 141. In particular, the doctor rod 146 in the present embodiment is magnetic, and the magnetic force that attracts the magnetic pole N2 of the magnet roller 147, and is attracted thereby, acts on the doctor rod 146. Accordingly, due to the magnetic force, the external force in the direction toward the developing sleeve 141 acts on the doctor rod 146. If the doctor rod 146 moves due to this magnetic force, the doctor gap DG changes, thus causing the amount of developer to pass through the doctor gap DG (transported to the developing range) to fluctuate. Therefore, in the present embodiment, the claws 148*d* and 148*e* inhibit the doctor rod 146 from approaching the developing sleeve 141, thereby stabilizing the amount of developer to pass through the doctor gap DG (transported to the developing range).

The developing device casing 144 includes a holder mount face 144*a* to which the doctor holders 148 are secured. Each of the doctor holders 148 according to the present embodiment includes an adjustment slot 148*b* to adjust the attachment positions of the doctor holders 148 on the holder mount face 144*a*. The adjustment slot 148*b* allows the adjustment in the approaching and parting direction B from the developing sleeve 141. Differently from the doctor rod 146, the doctor holder 148 includes the space for the adjustment slot 148*b*. Although limitations (e.g., rigidity, magnetic properties, and electric properties) are imposed on the doctor rod 146 to function as the developer regulator, fewer limitations are imposed on the doctor holder 148. Thus, the material of the doctor holder 148 can be selected considering the ease of processing, and the adjustment slot 148*b* can be produced at low cost.

In a state in which the doctor rod 146 is held by the doctor holders 148 having the adjustment slots 148*b*, the doctor holders 148 are secured to the holder mount face 144*a* of the developing device casing 144. At that time, the attachment, positions of the doctor holders 148 are adjustable within the span of the adjustment slot 148*b* in the approaching and parting direction B from the developing sleeve 141. With this configuration, the position at which the doctor rod 146 is secured to the developing device casing 144 is adjustable in the approaching and parting direction B from the developing sleeve 141.

The attachment positions of the doctor holders 148 are adjusted with, for example, a thickness gauge interposed between the developing sleeve 141 and the doctor rod 146. Then, screws 148*c* (illustrated in FIG. 5) are inserted, via the adjustment slots 148*b* of the doctor holders 148, into screw holes in the holder mount face 144*a* of the developing device casing 144, thereby securing the doctor holders 148 to the developing device casing 144. In this manner, the doctor gap DG can be set with a high degree of accuracy. In the present embodiment, the adjustment slots 148*b* of the doctor holders 148, the screw holes in the holder mount face 144*a* of the developing device casing 144, and the screws 148*c* together serve as a mechanism to adjustably secure the doctor rod 146 to the developing device casing 144.

In the present embodiment, the doctor holders 148 respectively support the both ends, or positions adjacent thereto, of the doctor rod 146. Since the two doctor holders 148 are separate from each other, the attachment position of each doctor holder 148 on the holder mount face 144*a* is individually adjustable in the direction in which the size of the doctor gap DG changes. By adjusting the attachment position of each doctor holder 148, the doctor gap DG can be set easily with deviations reduced over the entire length in the longitudinal direction of the doctor rod 146 (the axial direction of the developing sleeve 141).

As described above, in the present embodiment, the magnetic doctor rod 146 is susceptible to deformation due to magnetic force. To reduce the amount of deformation of the doctor rod 146 due to the magnetic force, it is conceivable to decrease the magnetic force strength of the regulation pole N2 of the magnet roller 147. However, as the magnetic three strength of the regulation pole N2 decreases, the amount of developer to pass through the doctor gap DG increases. Accordingly, n becomes necessary to make the doctor gap DG narrower relative to the target amount of developer to pass through the doctor gap DG (target amount of developer transported to the developing range). This tends to increase the fluctuations in the amount of developer to pass the doctor gap DG corresponding to the deviations of the doctor gap DG. Additionally, the possibility of clogging of the doctor gap DG with foreign substances increases, thereby increasing the possibility of image failure such as white streaks resulting from the foreign substance.

An experiment was executed to observe the occurrence of white streaks resulting from the doctor gap DG clogged with foreign substances, using two developing devices (Configurations 1 and 2) different in magnetic force strength of the regulation pole N2. In Configuration 1, the regulation pole N2 has a maximum magnetic flux density (in the direction normal to the developing sleeve 141) of 35 mT. In Configuration 2, the regulation pole N2 has a maximum magnetic flux density (in, the direction normal to the developing sleeve 141) of 40 mT. Solid image were printed successively, and white lines in the solid image were checked after printing at initial printing (0 sheet), 50,000 sheets, 100,000 sheets, and 150,000 sheets. Table 1 presents the results of the evaluation.

TABLE 1

| Regulation pole | Number of sheets printed | | | |
|---|---|---|---|---|
| Magnetic force strength | 0 | 50,000 | 100,000 | 150,000 |
| 35 mT | Good | Good | Poor | Poor |
| 40 mT | Good | Good | Good | Good |

In Table 1, the image was evaluated as "Good" when no white streak was observed and as "Poor" when a white streak was observed. In the evaluation, to keep the amount of developer to pass through the doctor gap DG identical, to 43 mg/cm$^2$, in both of Configurations 1 and 2, the doctor gap DG (the distance from the developing sleeve 141 to the doctor rod 1461 was set to 0.25 mm in Configuration 1 and 0.30 mm in Configuration 2.

Referring to Table 1, although the white streak was not observed even after printing of 150,000 sheets in Configuration 2, the white streak was observed after printing of 100,000 sheets in Configuration 1. It is conceivable that the inhibiting of white streaks in Configuration 2 is better since the doctor gap DG is wider than that in Configuration 1.

First Variation

Next, descriptions are given below of a first variation of attachment of the doctor rod 146 to the developing device casing 144.

As described above, compared with plate shaped developer regulators (doctor blades), rod-shaped developer regulators such as the doctor rod 146 bend easily. In the above-described embodiment, the both ends of the doctor rod 146 are supported by the doctor holders 148, respectively. Accordingly, a center portion of the doctor rod 146 in the longitudinal direction thereof is more likely to move (bend) than the end portions, due to the pressure from the developer, the weight of the doctor rod 146, and the magnetic force that attracts the magnetic pole N2 and is attracted thereby. Such deformation changes the size of the doctor gap DG in the center portion in the axial direction of the developing sleeve 141, thereby inhibiting transport of a stable amount of developer to the developing range or making the amount of developer transported to the developing range uneven in the axial direction of the developing sleeve 141. Thus, image quality is degraded.

Figure 11A:
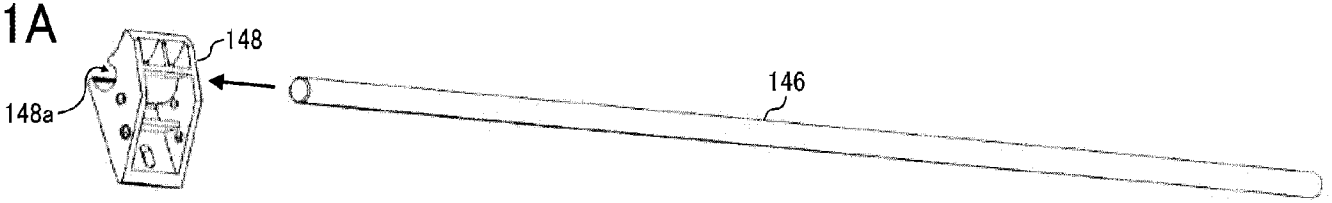
FIGS. 11A, 11B, and 11C are exploded perspective views of a developing device according to a first variation.
Figure 11B:
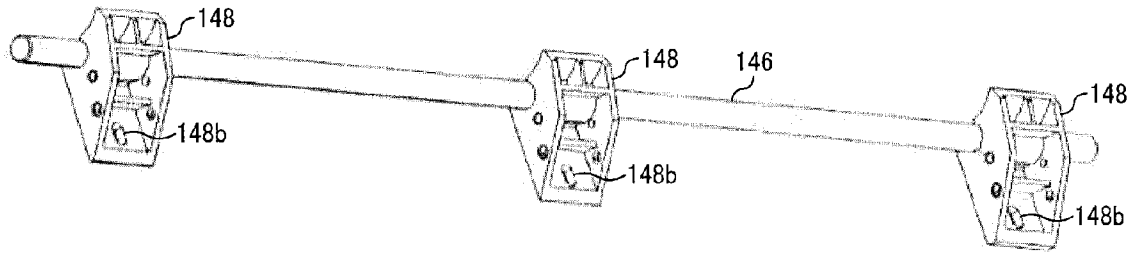
Figure 11C:
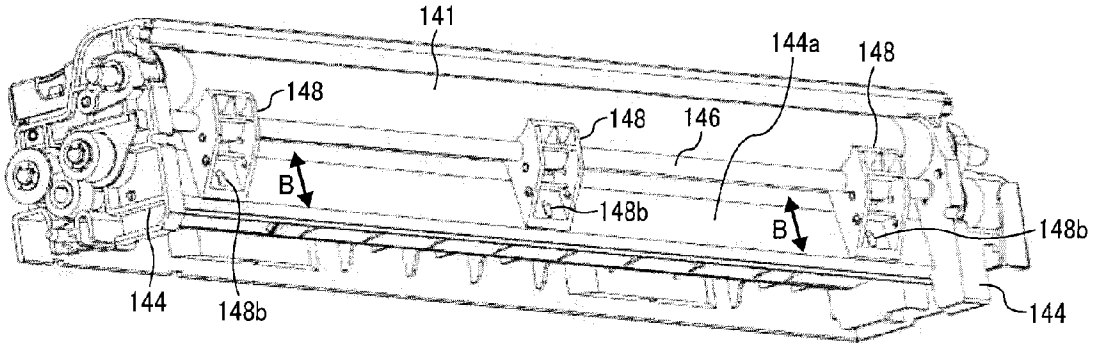

FIGS. 11A, 11B, and 11C are exploded perspective views of the developing device 14 according to the first variation.

The first variation is similar to the above-described embodiment bat different in that the doctor rod 146 is supported by three doctor holders 148. That is, another doctor holder 148 is added to support the center portion of the doctor rod 146 in the longitudinal direction thereof, in addition to the both end portions. The added doctor holder 148 is similar in structure to the doctor holders 148 to support the both end portions of the doctor rod 146 and screwed to the holder mount face 144*a* of the developing device casing 144 via the adjustment slot 148*b* similarly.

Descriptions are given below of a first experiment to ascertain effects of the first variation.

The doctor rod 146 used in the first experiment is made of magnetic Steel Use Stainless (SUS) according to Japan Industrial Standard (JIS) having a Young's modulus of 193 Gpa and 6 mm in diameter and 360 mm longitudinal direction thereof. The first experiment was executed using the configuration illustrated in FIG. 8B, including the two doctor holders 148 to support the both ends of the doctor rod 146, and the configuration according to the first variation (illustrated in FIG. 11B), including the three doctor holders 148. In each of the configurations illustrated in FIGS. 8B and 11B, a magnet of 60 mT equivalent to the regulation pole N2 was disposed, and the displacement amount at the center in the longitudinal direction of the doctor rod 146 was measured. The displacement amount in the former was 0.102 mm, and that in the latter was 0.024 mm. According to these results, the first variation better inhibits the deformation oldie doctor rod 146 and is more effective in stabilizing the amount of developer transported to the developing range and suppressing unevenness in developer conveyance in the axial direction of the developing sleeve 141.

In the first variation, since the three doctor holders 148 are separate from each other, the attachment position of each doctor holder 148 on the holder mount face 144*a* is individually adjustable in the direction in which the size of the doctor gap DG changes. In this configuration, for example, the doctor holder 148 that supports the center portion in the longitudinal direction of the doctor rod 146 is secured at a position closer to the developing sleeve 141 than the two doctor holders 148 that support the axial end portions. Accordingly, the doctor gap DG can be set narrower in the center portion than the end portions in the axial direction of the developing sleeve 141.

It is possible that the magnetic force exerted by the regulation pole N2 is stronger in the end portions than the center portion in the axial direction of the developing sleeve 141. In this case, the amount of developer to pass through the doctor gap DG is smaller in the end portions than the center portion in the axial direction of the developing sleeve 141. Accordingly, the amount of developer transported to the developing range becomes uneven if the doctor gap DG is uniform in the axial direction of the developing sleeve 141. In such a case, as in, the first variation, by setting the doctor gap DG narrower in the center portion than the axial end portions of the developing sleeve 141, the amount of developer transported to the developing range can be kept more uniform in the axial direction of the developing sleeve 141.

Although the doctor rod 146 is supported at three positions in the longitudinal direction thereof by the three doctor holders 148 in the first variation, the number of positions at which the doctor rod 146 is supported is not hunted thereto but can be greater. Such a configuration better inhibits the deformation of the doctor rod 146 and is more effective in stabilizing the amount of developer transported to the developing range and suppressing unevenness in developer conveyance in the axial direction of the developing sleeve 141.

In particular, disposing the support position of the doctor rod 146 in a range facing the developing range (i.e., a developing range width) in the axial direction of the developing sleeve 141 is advantageous in stabilizing the amount of developer transported in the developing range and suppressing unevenness in developer conveyance in the axial direction of the developing sleeve 141. Accordingly, such a configuration effectively inhibits unevenness in the amount of developer transported and adverse effects on the image, quality caused by uneven conveyance of developer in the axial direction of the developing sleeve 141.

Second Variation

Next, descriptions are given below of a second variation of attachment of the doctor rod 146 to the developing device casing 144.

In the work to attach the multiple doctor holders 148 individually on the holder mount face 144*a*, it is necessary that all of the doctor holders 148 support the doctor rod 146 in an identical posture and each doctor holder 148 supports a predetermined position in the longitudinal direction of the doctor rod 146. The work however, is complicated when each doctor holder 148 is separate.

Figure 12A:
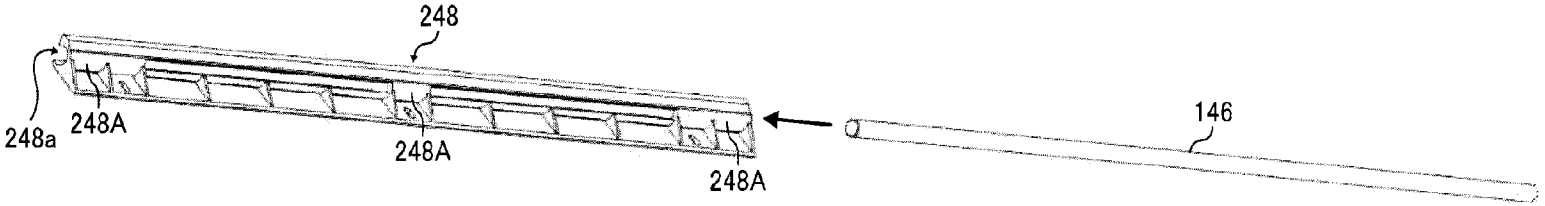
FIGS. 12A, 12B, and 12C are exploded perspective views of a developing device according to a second variation.
Figure 12B:
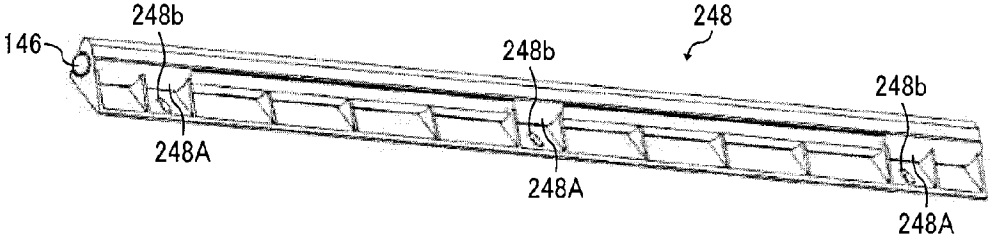
Figure 12C:
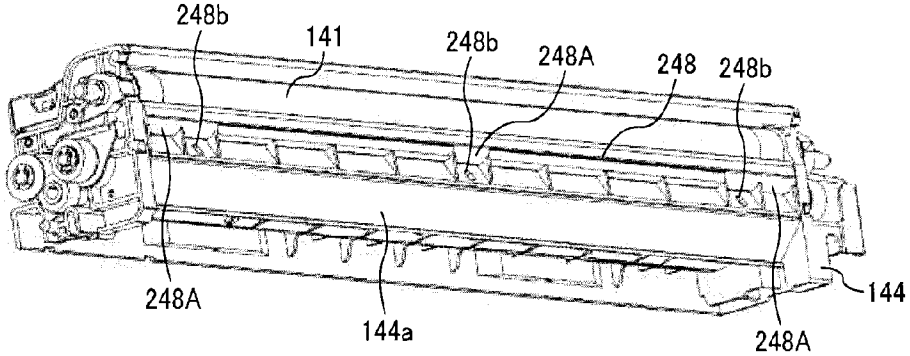

FIGS. 12A, 12B, and 12C are exploded perspective views of the developing device 14 according to the second variation.

In the second variation, the developing device 14 includes, to hold the doctor rod 146, a doctor holder 248 having three holder portions 248A to hold different positions of the doctor rod 146, apart in the longitudinal direction of the doctor rod 146. The holder portions 248A are coupled to each other. Each holder portion 248A has an insertion opening 248*a*. In the second variation, to secure the doctor rod 146 to the developing device casing 144, as illustrated in FIG. 12A, initially, the doctor rod 146 as inserted into the insertion opening 248*a* of each holder portion 248A of the doctor holder 248, which is a separate component from the doctor rod 146. Then, as illustrated in FIG. 12B, the doctor holder 248 holds the doctor rod 146 at three positions, with the three insertion openings 248*a*, respectively. That is, the three positions of the doctor rod 146 are supported by the three holder portions 248A, respectively.

The doctor holder 248 according to the second variation includes adjustment slots 248*b* to adjust the attachment positions of the doctor holder 248 on the holder mount face 144*a*, and the adjustment slots 248*b* allow the adjustment in the approaching and parting direction from the developing sleeve 141. Accordingly, in attaching the doctor holder 248 to the holder mount face 144*a* of the developing device casing 144, with the doctor rod 146 held by the doctor holder 248, the position at which the doctor rod 146 is secured to the developing device casing 144 is adjustable in the approaching and parting direction from the developing sleeve 141, similar to the above-described embodiment.

Therefore, while the attachment position of each holder portion 248A of the doctor holder 248 is adjusted with, for example, a thickness gauge interposed between the developing sleeve 141 and the doctor rod 146, screws are inserted, via the adjustment slots 248*b* of the doctor holder 248, into the screw holes in the holder mount face 144*a*, thereby securing the doctor holder 248 to the developing device casing 144. In this manner, the doctor gap DG can be set with a high degree of accuracy.

The doctor holder 248 according to the variation 2 is a flexible component. Accordingly, the doctor holder 248 is deformable to individually adjust, in the direction to change the doctor gap DG, the attachment position of each holder portion 248A to the holder mount face 144*a* of the developing device casing 144. By adjusting the attachment position of each holder portion 248A, the doctor gap DG can be set easily with deviations reduced over the entire length in the longitudinal direction of the doctor rod 144 (the axial direction of the developing sleeve 141), also in the second variation.

Although the doctor rod 146 is supported at three positions in the longitudinal direction thereof by the three holder portions 248A in the second variation, the number of positions at which the doctor rod 146 is supported is not limited thereto but can be greater. Such a configuration better inhibits the deformation of the doctor rod 146 and is more effective in stabilizing the amount of developer transported to the developing range and suppressing unevenness in developer conveyance in the axial direction of the developing sleeve 141.

Also in the second variation, disposing the support position at which the holder portion 248A supports the doctor rod 146 within the developing range width in the axial direction of the developing sleeve 141 is advantageous in stabilizing the amount of developer transported in the developing range and suppressing unevenness in developer conveyance in the axial direction of the developing sleeve 141. Accordingly, such a configuration effectively inhibits unevenness in the amount of developer transported and adverse effects on the image quality caused by uneven conveyance of developer in the axial direction of the developing sleeve 141.

Third Variation

Next, descriptions are given below, of a developing device according to a third variation.

As described above, compared with plate-shaped developer regulators (doctor blades), rod-shaped developer regulators such as the doctor rod 146 bend easily. Deformation of the doctor rod 146 may result in unstable amount of developer transported to the developing range and uneven conveyance of developer in the axial direction of the developing sleeve 141. A conceivable approach to inhibit such inconveniences is reducing the force that causes the doctor rod 146 to deform, in addition to increasing the number of support positions at which the doctor holder 148 or 248 supports the doctor rod 146 as described as the first and second variations.

In the third variation, deformation of a doctor rod 246 is inhibited with the magnetic three of a magnet roller 247. Specifically, the doctor rod 246 according to the third variation is made of a nonmagnetic material. With this configuration, the doctor rod 246 is inhibited from being deformed by the magnetic force of the magnet roller 247.

Figure 13:
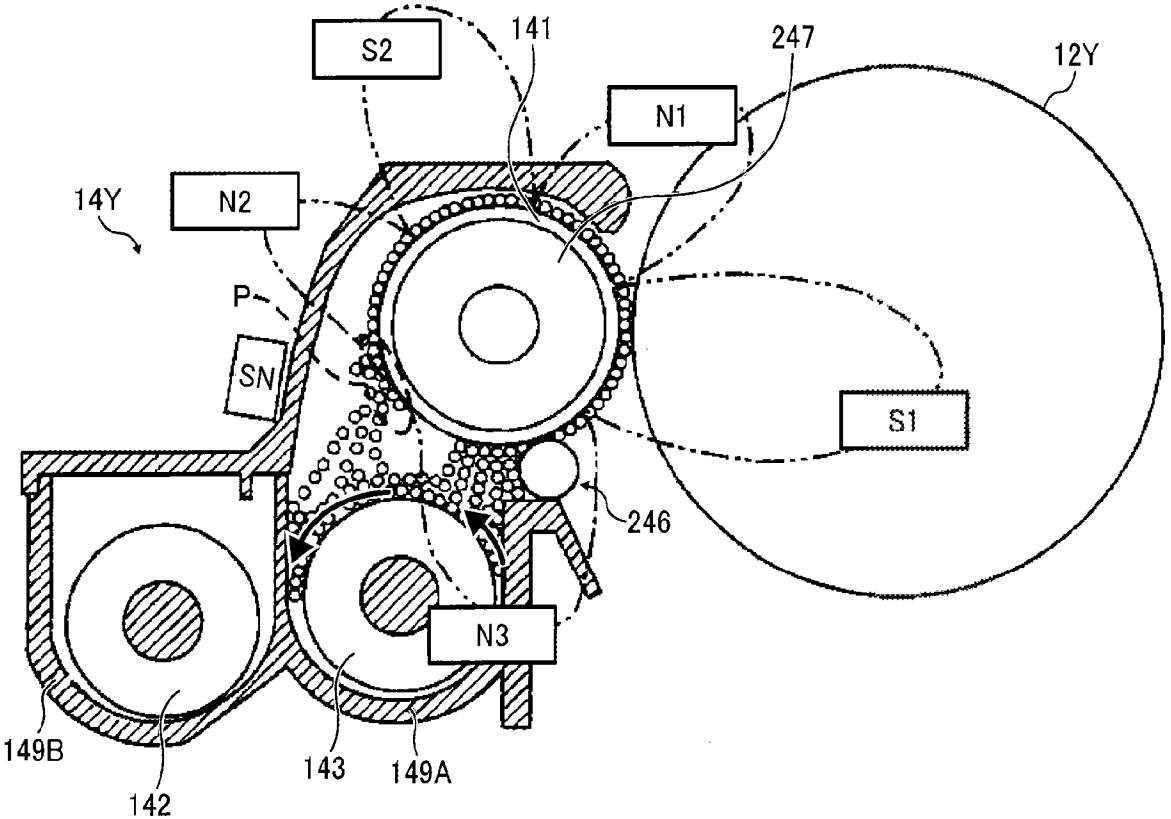
FIG. 13 is a schematic cross-sectional view of a developing device according, to a third variation, together with distribution of magnetic flux density (in absolute value) in a direction normal to the surface of the developing sleeve.

FIG. 13 is a schematic cross-sectional view of the developing device 14Y according to the third variation, together with distribution of magnetic flux density (in absolute value) in a direction normal to the surface of the developing sleeve 141, indicated by chain double-dashed lines.

In FIG. 13, the magnet roller 247 has a development pole S1 facing the photoconductor drum 12Y, a conveyance pole N1, a conveyance pole S2, an upstream release pole N2, and a pole N3 (for scooping and regulating the developer), which are disposed counterclockwise along the circumference of the developing sleeve 141 the developer conveyance direction by the developing sleeve 141).

In the above-described configuration illustrated in FIG. 6, while the developer is scooped onto the developing sleeve 141 and passes through the doctor gap DG (from the pole S3 for releasing and scooping to the regulation pole N2), the developer passes by three polarity change points. The polarity change points increase the stress, on the developer and promote the degradation of developer. Such degradation is conceivably caused as follows. When a large amount of developer scooped onto the developing sleeve 141 (before regulated in the doctor gap DG) passes by the polarity change points, the developer is moved largely with the magnetic force, under a strong restraint. At that time, friction is caused between the carrier and the toner in the developer, and the developer receives a large stress.

In view of the foregoing, in the third variation, as illustrated in FIG. 13, the magnet roller 247 has a magnetic pole arrangement such that no polarity change point is present in the range from the position to scoop the developer onto the developing sleeve 141 to the doctor gap DG. This configuration can alleviate the stress on the developer and inhibit degradation of the developer.

It is to be noted that, in the third variation, the pole N3, positioned closest to the doctor gap DG among the magnetic poles of the magnet roller 247, requires both of the force to scoop the developer onto the developing sleeve 141 and the force to transport the developer through the doctor gap DG. By contrast, in the configuration illustrated in FIG. 6, the pole S3 for releasing and scooping exerts the force to scoop the developer onto the developing sleeve 141, and the regulation pole N2 exerts the three to transport the developer through the doctor gap DG. Therefore, in the magnetic pole arrangement according to the third variation, the pole N3 requires a stronger magnetic force than that of the regulation pole N2 and the pole S3 for releasing and scooping in the configuration illustrated in FIG. 6.

In the magnetic pole arrangement having the pole N3 to exerts the stronger magnetic force, if the doctor rod 246 is magnetic, the magnetic force to deform the doctor rod 246 is stronger, and it becomes difficult to stabilize the amount of developer transported to the developing range and suppress unevenness in the developer conveyance in the axial direction of the developing sleeve 141. Accordingly, to alleviate the stress on the developer, the doctor rod 246 is preferably a nonmagnetic body in the magnetic pole arrangement in which no polarity change point is present in the range from the position to scoop the developer onto the developing sleeve 141 to the doctor gap DG.

In FIG. 13, reference character P1 represents a developer release range defined on the developing sleeve 141. Where the upstream release pole N2 and the pole N3 together apply the three (i.e., releasing force), to the developer borne on the developing sleeve 141, to move away from the developing sleeve 141. In the third variation, the developer release range P1 is disposed not overlap with the developer contained in the supply compartment 149A. With this arrangement, in the developer release range P1, even if developer remains on the developing sleeve 141, the developer is not scraped off by the developer inside the supply compartment 149A. In this configuration, the stress on the developer is smaller compared with a configuration in which the developer release range P1 overlaps with the developer inside the supply compartment 149A.

Additionally, if shearing force is given to the developer standing on end and aggregating as the magnetic brush due to the magnetic force of the pole N3, the developer receives a strong stress. For example, the shearing force is given from the conveying screw 143 or the developer transported in the axial direction by the conveying screw 143. Third variation is configured so that the developer standing on end and aggregating as the magnetic brush receives little shearing force from the conveying screw 143 or from the developer transported in the axial direction by the conveying screw 143. Thus, the stress on the developer can be alleviated.

Fourth Variation

Next, descriptions are given below of a developing device according to a fourth variation.

In the fourth variation, although the magnetic pole arrangement of the magnet roller 247 is identical to that of the third variation (illustrated in FIG. 13), the doctor rod 146 made of a magnetic material is used, instead of the nonmagnetic doctor rod 246.

As described above with reference to FIG. 13, in the magnetic pole arrangement in which no polarity change point is present in the range from the position to scoop the developer onto the developing, sleeve 141 to the doctor gap DG, although the stress on developer is alleviated, it is necessary that the pole N3 for releasing and scooping exerts a relatively large magnetic force. However, when the doctor rod 146 made of a magnetic material is used as the developer regulator as in the fourth variation, it is preferred that the magnetic force of the pole N3 be smaller in inhibiting the deformation of the doctor rod 146, thereby stabilizing the amount of developer transported to the developing range and developer conveyance in the axial direction of the developing sleeve 141.

Reduction in the magnetic force of the pole N3 results in decreases in the force to scoop the developer onto the pole N3, and the amount of developer transported to the developing range decreases. Consequently, there is a risk of degradation in image quality such as image fading. Table 2 below presents results of a test to observe the occurrence of image fading when the magnetic force of the pole N3 for releasing and scooping is changed.

TABLE 2

| Magnetic force strength | 40 mT | 50 mT | 60 mT |
|---|---|---|---|
| Image fading | Poor | Good | Good |

In this test, using three configurations in which the magnetic force of the pole N3 (for releasing, scooping, and regulating) was different (40 mT, 50 mT, and 60 mT), solid images were consecutively printed, as endurance test, to observe image fading. In Table 2, the image was evaluated as "Good" when no image fading was observed and as "Poor" when image fading was observed. According to the results of the test, as illustrated in Table 2, it is preferable that the pole N3 (for releasing, scooping, and regulating developer) has a maximum magnetic flux density (in the direction normal to the developing sleeve 141) of 50 mT or greater.

Figure 14:
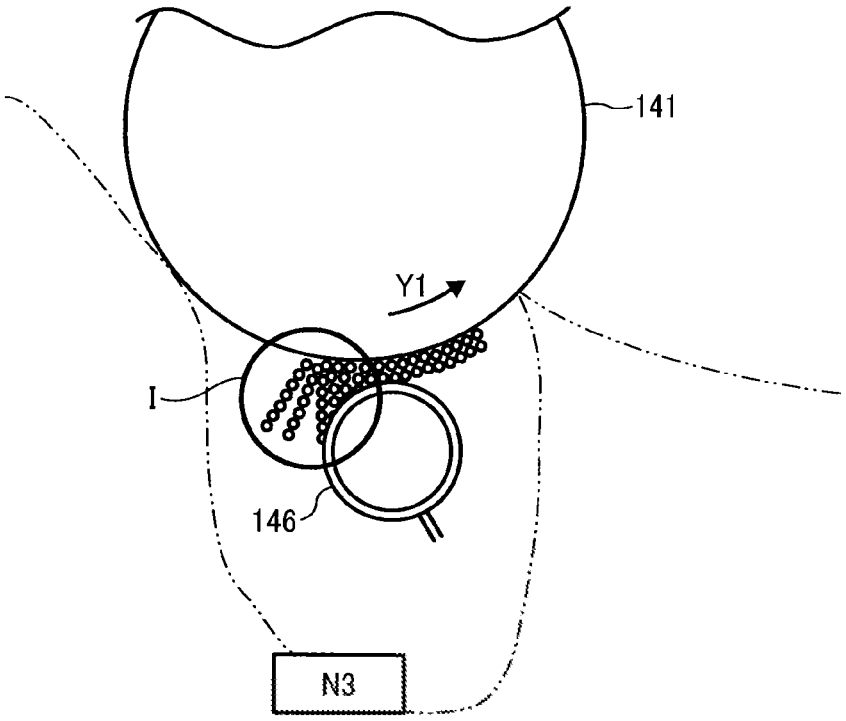
FIG. 14 is a schematic cross-sectional view of a developing device according to a fourth variation, for understanding a state in which the amount of developer is greater upstream from the doctor rod.

However, when the pole N3 has the maximum magnetic flux density (in the direction normal to the developing sleeve 141) of 50 mT or greater, the amount of developer increases in a range 1 illustrated in FIG. 14, which is upstream from the doctor rod 146 in the direction of rotation of the developing sleeve 141 indicated by arrow Y1. Accordingly, the amount of developer moving to the doctor gap DG is greater, and the developer applies a greater stress on the doctor rod 146. At that time, in the configuration illustrated in FIG. 6 in which the two doctor holders 148 support the axial ends (or positions adjacent thereto) of the doctor rod 146, the difference in the amount of developer that passes through the doctor gap DG (the amount of developer transported to the developing range) between the axial end portion and the center portion can be 15% or greater. The difference is out of a practical allowable range.

Therefore, in the fourth variation, similar to the above-described first and second variations, the center position of the doctor rod 146 is supported, by the doctor holder 148 or 248, in addition to the both ends in the longitudinal direction of the doctor rod 146. With this configuration, as illustrated in FIG. 13, while adopting the magnetic pole arrangement in which the developer scooped onto the developing sleeve 141 passes no polarity change point until the developer passes through the doctor gap DG to alleviate the stress on developer, image quality degradation, such as image fading, is suppressed by setting the maximum magnetic flux density (in the direction normal to the developing sleeve 141) of the pole N3 for releasing, scooping, and regulating developer to 50 mT or greater. Simultaneously, the deformation of the doctor rod 146 is inhibited, thereby inhibiting the amount of developer transported through the doctor gap DG to the developing range from becoming uneven in the axial direction of the developing sleeve 141.

Fifth Variation

Next, descriptions are given below of a developing device according to a fifth variation.

Compared with plate shaped developer regulators (doctor blades), rod-shaped developer regulators such as the doctor rods 146 and 246 bend easily. Deformation of the doctor rod 146 may result in unstable amount of developer transported to the developing range and uneven conveyance of developer in the axial direction of the developing sleeve 141. A conceivable approach to inhibit such inconveniences is securing both ends of the doctor rods 146 and 246 strongly to reduce deformation, in addition to increasing, the number of support positions at which the doctor holder 148 or 248 supports the doctor rod 146 and reducing the force that causes the deformation of the doctor rod 146 as described in the first through fourth variations.

Specifically, in the doctor holders 148 and 248 according to the first through fourth variations, the insertion openings 148*a* and 248*a* cover a part of the circumference (about 270 degrees) of the doctor rod 146 (or 246), with the doctor rod 146 pinched between the two claws 148*d* and 148*e*. In this configuration, although the doctor rods 146 and 246 can be secured with the elastic resilience of the doctor holders 148 and 248, it is difficult to strongly hold the doctor rods 146 and 246 to protect the doctor rods 146 and 246 from the bending force.

Figure 15:
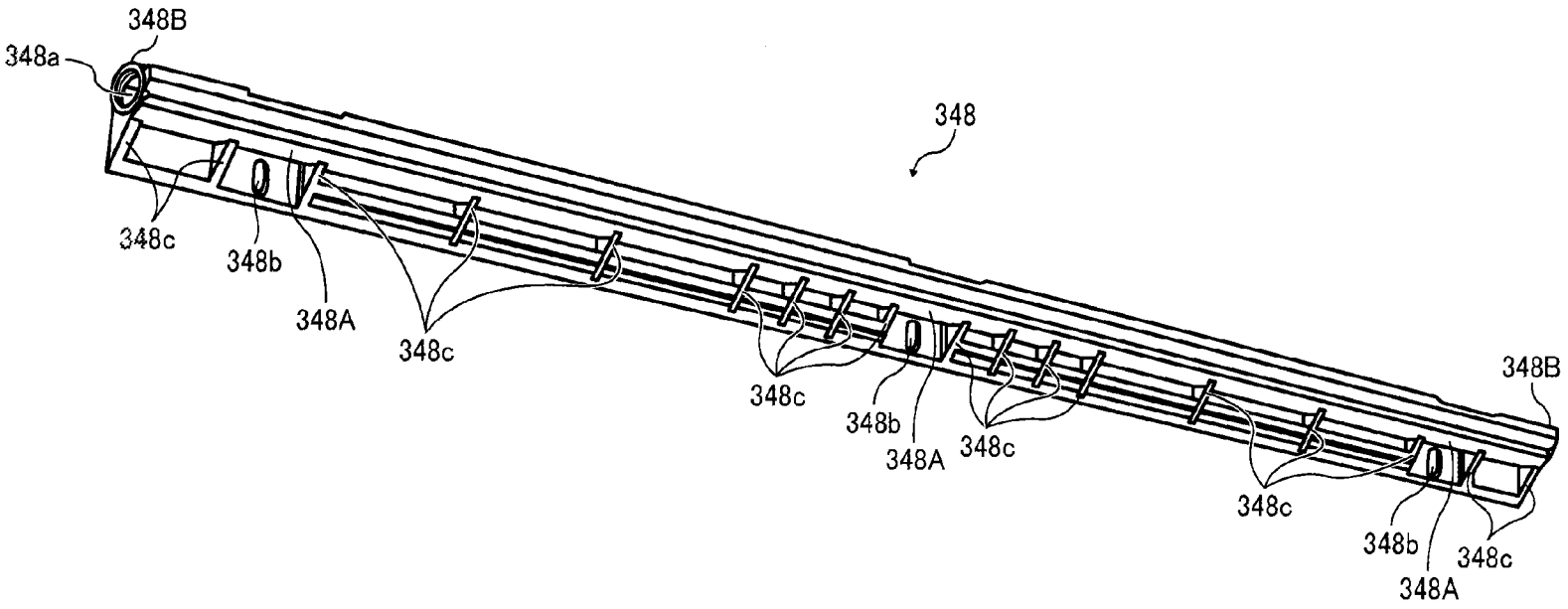
FIG. 15 is a perspective view of a doctor holder according to a fifth variation.
Figure 16:
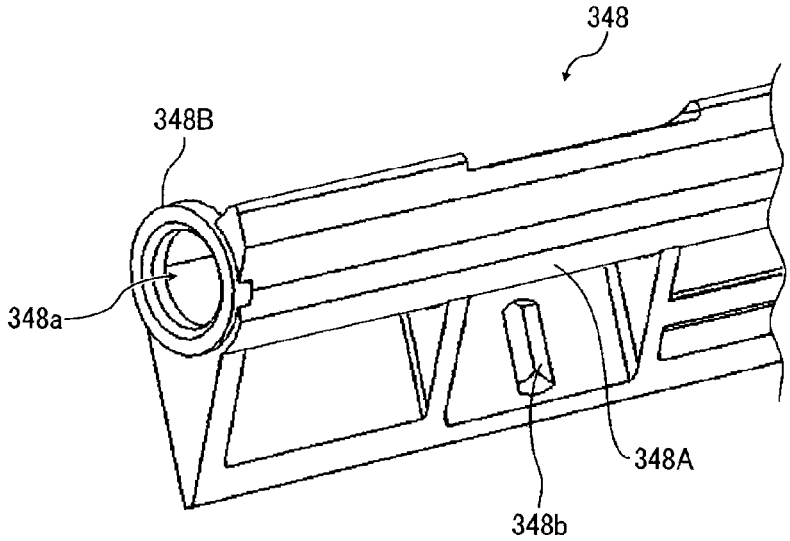
FIG. 16 is an enlarged perspective view illustrating an end portion of the doctor holder illustrated in FIG. 15.
Figure 17:
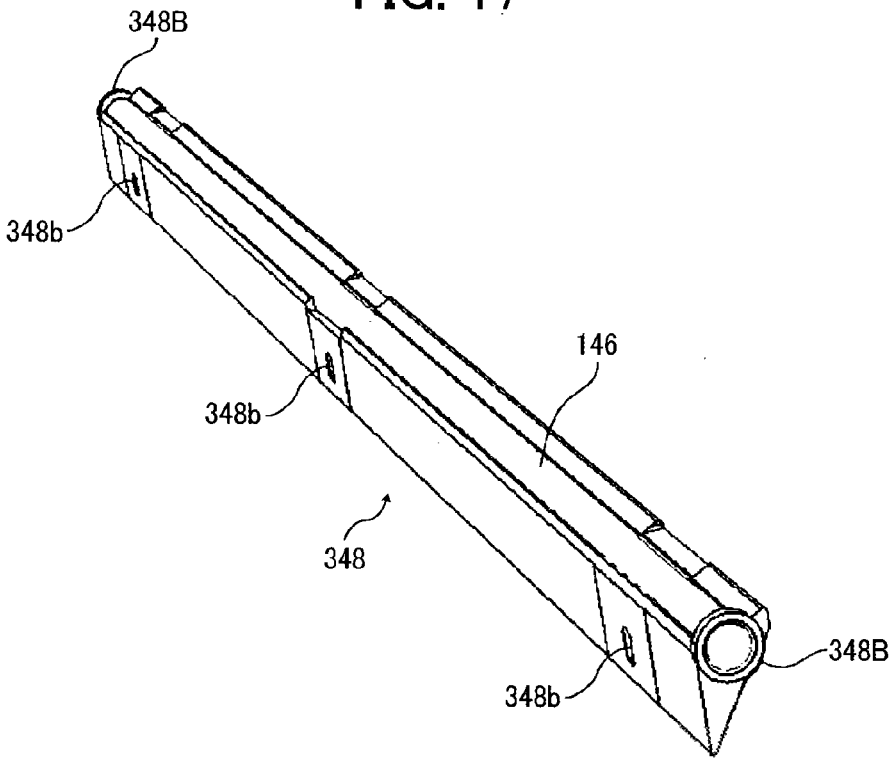
FIG. 17 is a perspective view illustrating a doctor rod attached to the doctor holder according to the fifth variation.

FIG. 15 is a perspective view of a doctor holder 348 according to the fifth variation, and FIG. 16 is a perspective view of an end portion of the doctor holder 348. FIG. 17 is a perspective view illustrating a state in which the doctor rod 146 is attached to the doctor holder 348.

The doctor holder 348 is basically similar to the doctor holder 248 in the second variation and includes three holder portions 348A to hold different positions of the doctor rod 146, apart in the longitudinal direction of the doctor rod 146. The holder portions 248A are coupled to each, other. The doctor rod 146 is inserted into an insertion opening 348*a* of the doctor holder 348.

As illustrated in FIG. 16, the doctor holder 348 includes rings 348B (i.e., a full-circumference retainer) disposed at both ends of the doctor holder 348. Both ends of the doctor rod 146 are inserted into the rings 348B, respectively. Thus, the doctor holder 348 holds the doctor rod 146 with the rings 348B covering the entire circumference of the doctor rod 146 at both ends. With this configuration, compared with the first through fourth variations in which a part (e.g., about 270 degrees) of the circumference of each end of the doctor rods 148 and 246 is covered, the doctor rod 146 is secured with a sufficient strength to inhibit the doctor rod 146 from bending even when the bending force acts on the doctor rod 146.

Figure 18:
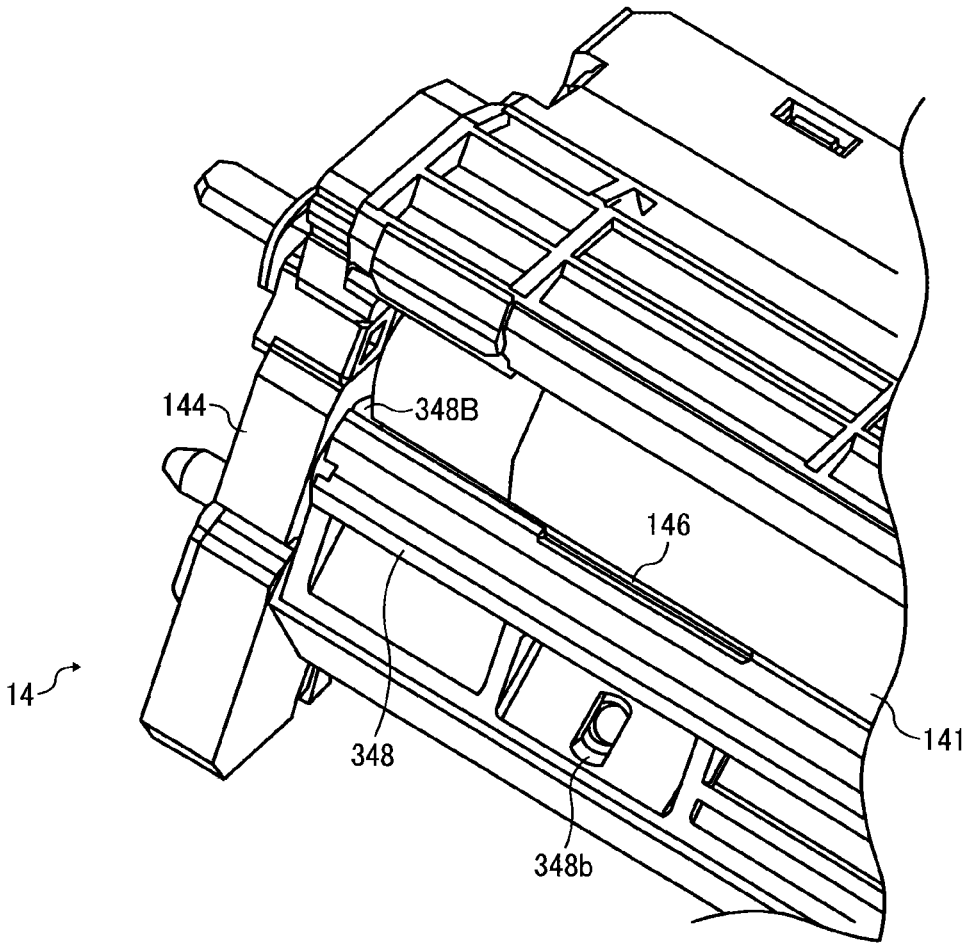
FIG. 18 is an enlarged perspective view of an end portion of a developing device according to the fifth variation, in the axial direction of the developing sleeve, as viewed from the developing range.

FIG. 18 is an enlarged perspective view of an end portion of the developing device 14 according to the fifth variation, in the axial direction of the developing sleeve 141, as viewed from the developing range.

In the fifth variation, as illustrated in FIG. 18, the rings 348B supporting both ends of the doctor rod 146 are disposed outside a range of the surface of the developing sleeve 141 that passes through the developing range in the axial direction of the developing sleeve 141. Accordingly, the doctor rod 146 can regulate the amount of developer passing through the developing in the entire length in the axial direction of the developing sleeve 141.

Further, in the fifth variation, as illustrated in FIG. 18 the rings 348B supporting both ends of the doctor rod 146 are disposed outside the outer circumferential face of the developing sleeve 141 in the axial direction thereof. Each ring 348B is disposed facing a clearance between the end lace of the developing sleeve 141 and the inner face of the developing device casing 144. With this structure, the rings 348B can have a thickness (a length in the direction perpendicular to the axial direction of the developing sleeve 141) wider than the doctor gap DG. Accordingly, a thicker ring can be used for the ring 348B to strongly hold the doctor rod 146 with a higher rigidity.

It is to be noted that the doctor older 348 according to the fifth variation includes adjustment slots 348*b* to adjust the attachment positions of the doctor holder 348 on the holder mourn face 144*a*, and the adjustment slots 348*b* allow the adjustment in the approaching and parting direction from the developing sleeve 141. Accordingly, when the doctor holder 348 is secured to the holder mount Pace 144*a* of the developing device casing 144 with the doctor rod 146 held thereby, the position at which the doctor rod 146 is secured to the developing device casing 144 is adjustable in the approaching and parting direction from the developing sleeve 141, similar to the above-described embodiment. Thus, the doctor gap DG can be set with a higher accuracy.

Figure 19:
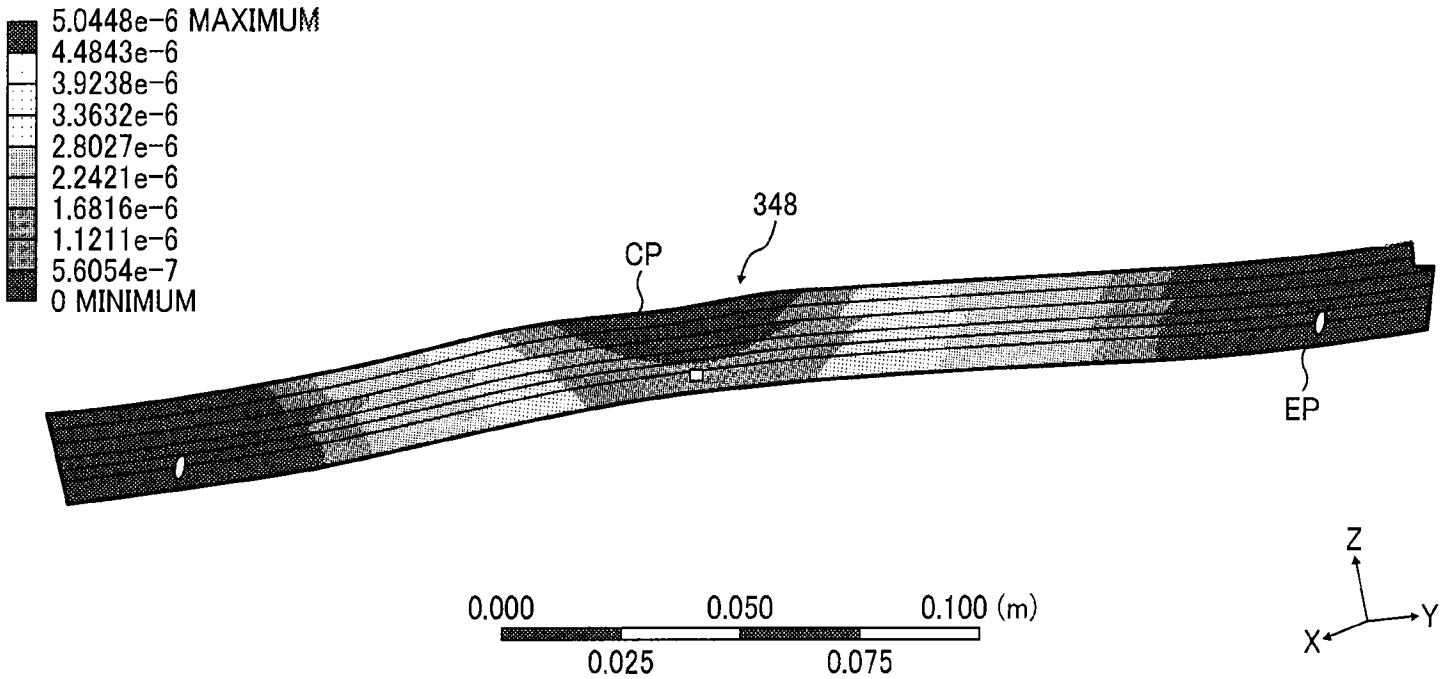
FIG. 19 is a diagram illustrating results of strength simulation of the doctor rod.

The doctor holder 348 is made of a flexible material, and the doctor holder 348 have multiple ribs 348*c* spaced in the longitudinal direction of the doctor rod 146 to enhance the rigidity of the doctor holder 348, similar to the doctor holder 248 according to the second variation. As can be clear from the results of strength simulation presented in FIG. 19, the deformation amount of the doctor holder 348 is greater in the center portion (represented by "CP" in FIG. 19) than in the end portions (represented by "EP" in FIG. 19).

It is to be noted that, in FIG. 19C, numerals in the upper left are the deformation amount in meters when a uniformly distributed load of 1 N/m is applied, and a scale in meters, is illustrated on the bottom. The deformation is illustrated in emphasized manner by magnifying the deformation amount.

Accordingly, in the fifth variation, as illustrated in FIG. 15, the intervals between the ribs 348*c* in the longitudinal direction of the doctor rod 146 are smaller in the center portion than the end portions. With this arrangement, the rigidity of the doctor holder 248 is higher in the center portion than the end portions, and deformation of the doctor holder 248 is inhibited. Accordingly, deformation of the doctor rod 146 is inhibited.

It is to be noted that, the number of positions in the longitudinal direction of the doctor rod 146, at which the doctor rod 146 is supported, can be four or greater.

In the fifth variation, disposing the support position at which the holder 348A supports the doctor rod 146 within the developing range width is advantageous in stabilizing the amount of developer transported in the developing range and suppressing unevenness in developer conveyance in the axial direction of the developing sleeve 141.

Figure 20:
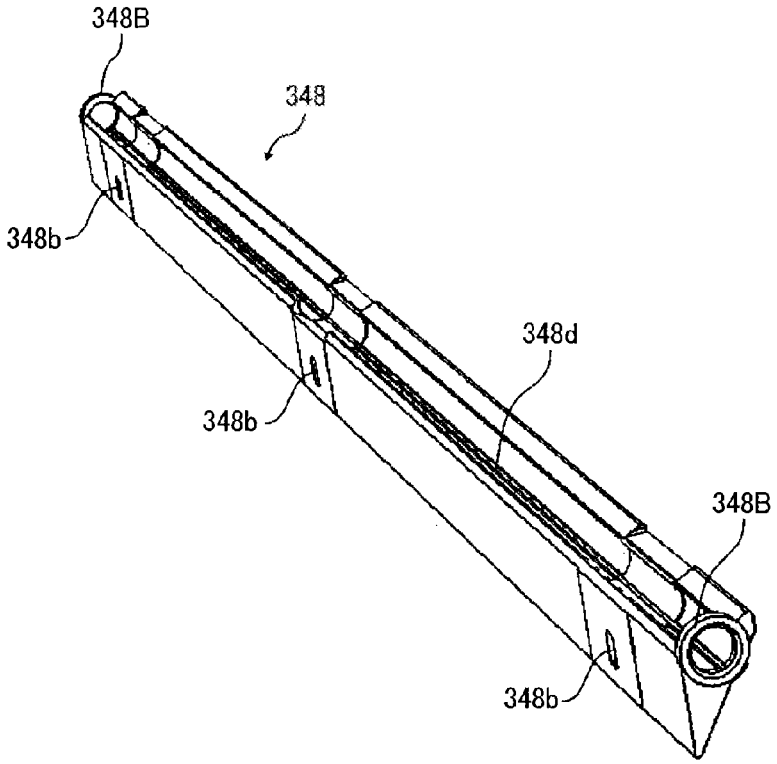
FIG. 20 is a perspective view illustrating an inner face of the doctor holder according to the fifth variation, to hold the doctor rod.
Figure 21:
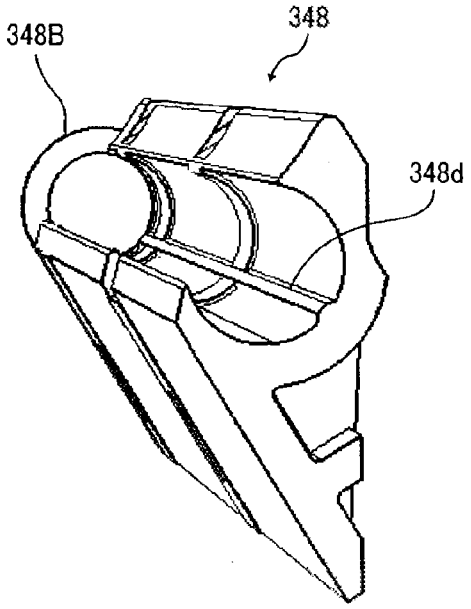
FIG. 21 is an enlarged perspective view illustrating the end portion of the doctor holder in the longitudinal direction of the doctor rod.
Figure 22:
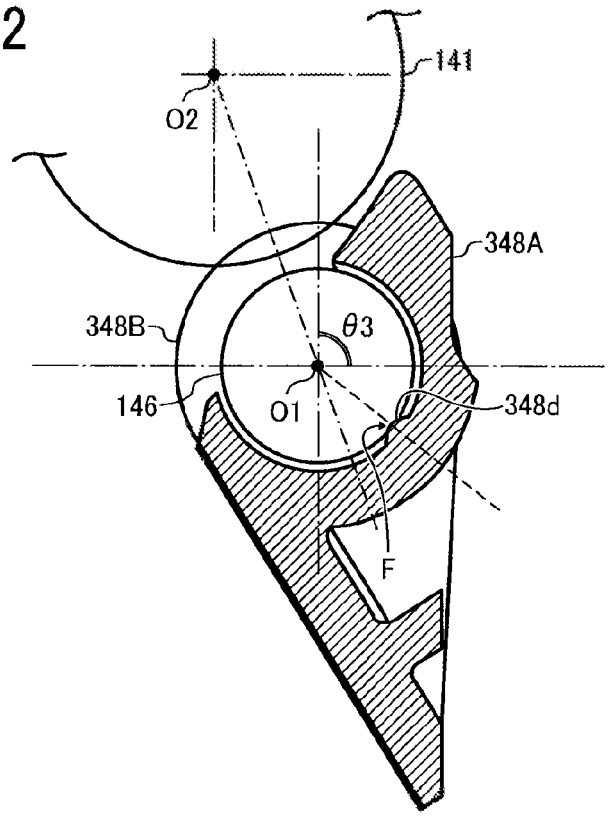
FIG. 22 is a cross-sectional view of the doctor holder according to the fifth variation, perpendicular to the longitudinal direction of the doctor rod.

FIG. 20 is a perspective view illustrating an inner face of the doctor holder 348 according to the fifth variation, to hold the doctor rod 146. FIG. 21 is an enlarged perspective view illustrating the end portion of the doctor holder 348 in the longitudinal direction of the doctor rod 146. FIG. 22 is a cross-sectional view of the doctor holder 348 according to the fifth variation, perpendicular to the longitudinal direction of the doctor rod 146.

The doctor holder 348 according to the fifth variation further includes a contact protrusion 348*d* (shaped like a rib) extending an approximately entire longitudinal length of the doctor rod 144 to contact the doctor rod 146 substantially entirely, in the longitudinal direction. The contact protrusion 348*d* is disposed on inner faces of the three holder portions 348A and coupling portions coupling the holder portions 348A. Referring to FIG. 22, a segment O1-F refers to a segment connecting the center O1 (center of gravity) of the doctor rod 146 and a point F where the contact protrusion 348*d* contacts the doctor rod 146, and the segment O1-O2 refers to the segment connecting the center O1 of the doctor rod 146 and the center O2 of the developing sleeve 141. The contact protrusion 348*d* is disposed such that, on the cross section (illustrated in FIG. 22) perpendicular to the longitudinal direction of the doctor rod 146, an angle θ3 between the segment O1-F and the segment O1-O2 is 180 degrees or smaller.

As described above, the doctor rod 146 receives, from the developer passing through the doctor gap DG, a pressing force to the downstream side in the passing direction indicated by arrow Y2, in which the developer passes through the doctor gap DG. With the above-described placement of the contact protrusion 348*d* according to the fifth variation (i.e., the angle θ3 is not greater than 180 degrees), the contact protrusion 348*d* can receive at least a part of the pressing force given to the doctor rod 146 from the developer. Since the contact protrusion 348*d* contacts the doctor rod 146 substantially entirely in the longitudinal direction of the doctor rod 146, the pressing force given to the center portion of the doctor rod 146, which is greater than the pressing force given to the end portion, is received by the contact protrusion 348*d* in a manner dispersed in the longitudinal direction of the doctor rod 146. As a result, the doctor rod 146 is effectively prevented from deforming due to the pressing force from the developer, and the amount of developer to, pass through the doctor gap DG (transported to the developing range) can be stable.

Descriptions are given below of an experiment to ascertain effects of the fifth variation.

Similar to the above-described experiment to ascertain the effect of the first variation, the doctor rod 146 used in the second experiment is made of magnetic Steel Use Stainless (SUS) having a Young's modulus of 193 Gpa and 6 mm in diameter and 360 mm in longitudinal direction. The second experiment was executed using the doctor holder according to the fifth variation. That is, a part of the circumference of the doctor rod 146 was supported at the center portion and portions adjacent to both ends (three portions), and the entire circumference of the doctor rod 146 was supported at both ends with the rings 348B. In such a configuration, a magnet of 60 mT equivalent to the regulation pole N2 was disposed, and the displacement amount of the center portion of the doctor rod 146 in the longitudinal direction thereof was measured. In this experiment, the displacement amount was 0.012 mm. Thus, according to the fifth variation, deformation of the doctor rod 146 is reduced by about half compared with the above-described first variation. Accordingly, the fifth variation is more effective in stabilizing the amount of developer transported to the developing range and suppressing unevenness in developer conveyance in the axial direction of the developing sleeve 141.

Sixth Variation

Next, descriptions are given below of a developing device according to yet another variation (sixth variation).

In the above-described embodiment, as illustrated in FIG. 9, the doctor holder 148 includes the claws 148*d* and 148*e* to pinch the doctor rod 146, and the doctor holder 148 holds the doctor rod 146 with the elastic resilience due to the displacement of the claws 148*d* and 148*e* (i.e., the widened cutout). To attach the doctor holder 148 to the developing device casing 144, an attached face of the doctor holder 148 having the adjustment slot 148*b* is disposed adjoining the holder mount face 144*a* of the developing device casing 144. Then, the attachment position of the doctor holder 148 relative to the developing device casing 144 is adjusted within the span of the adjustment slot 148*b*, and the doctor holder 148 is secured to the developing device casing 144 with a fastening such as a screw. At that time, adjustment of the attachment position of the doctor holder 148 is difficult if the claw 148*e*, which is closer to the attached face having the adjustment slot 148*b*, is displaced (deformed) by a greater amount as the claw 148*e* holds the doctor rod 146. However, when the displacement amount of the claws 148*d* and 148*e* is simply reduced, the elastic resilience necessary to, reliably hold the doctor rod 146 is not attained.

Figure 23:
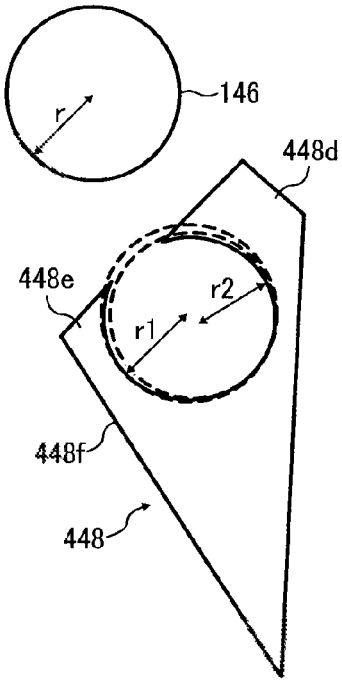
FIG. 23 is an end-on axial view of claws of a doctor holder according to a sixth variation on a cross section perpendicular to the longitudinal direction of the doctor rod.

FIG. 23 is an end-on axial view of a doctor holder 118 to support the doctor rod 146, on a cross section perpendicular to the longitudinal direction of the doctor rod 146.

In FIG. 23, reference character 448*f* represents the attached face having a slot 448*b*. A claw 448*e* closer to the attached face 448*f* than a claw 448*d* is shaped such that, when the doctor holder 448 holds the doctor rod 146, the claw 448*e* deforms a smaller amount than the claw 448*d*. Specifically, an inner face (facing the circumferential face of the doctor rod 146) of the claw 448*e* has a curvature radius r1 greater than a curvature radius r2 of an inner face of the claw 448*d*.

According to the sixth variation, while maintaining the strength (i.e., the elastic resilience) to hold the doctor rod 146, the amount of deformation (caused by the doctor rod 146 held therein) of the claw 448*e* closer to the attached face 448*f* is reduced. With this structure, when the attachment position of the doctor holder 448 relative to the developing device casing 144 is adjusted and the attached face 448*f* having the slot 448*b* is secured to the holder mount face 144*a*, the deformation amount of the attached face 448*f* is smaller, thus making it easier to adjust the attachment position of the doctor holder 448 on the developing device casing 144.

In particular, although it is necessary to make the curvature radius r2 of the inner face of the claw 448*d* smaller than a radius r of the doctor rod 146, the curvature radius r1 of the claw 448*e* closer to the attached face 448*f* can be equal to or greater than the radius r of the doctor rod 146. In this case, in holding the doctor rod 146, the claw 448*e* does not deform, and the attached face 448*f* does not deform. Accordingly, this structure is more advantageous in facilitating the adjustment of the attachment position of the doctor holder 448 on the developing device casing 144.

Seventh Variation

Next, descriptions are given below of a developing device according to a seventh variation.

To attach the doctor holders 148, 248, 348, and 448 (collectively "doctor holders 148"), according to the above-described embodiment and the first through sixth variations, to the developing device casing 144, the attached face having the adjustment slot 148*b* is disposed adjoining the holder mount face 144*a* and secured thereto. In such, a manner, a strong holding power is maintained against an external force in planar direction along the holder mount face 144*a* or the direction in which the attached face (448*f*) of the doctor holder 148 and the holder mount face 144*a* approach each other. However, against an external force in the direction in which the attached face (448*f*) of the doctor holder 148 and the holder mount face 144*a* draw away from each other, the holding power is relatively weak, and, in some cases, it is difficult to keep the attached face on the holder mount face 144*a*. In particular, while the doctor rod 146 receives the pressing force (in the passing direction Y2) from the developer passing through the doctor gap DG, the pressing force acts in the direction in which the attached face of the doctor holder 148 and the holder mount face 144*a* draw away from each other. Accordingly, there is a risk that the attachment becomes unstable. If the attached face of the doctor holder 148 is disengaged from the holder mount face 144*a*, the doctor gap DG changes, thereby inhibiting transport of a stable amount of developer to the developer or making the amount of the developer transported uneven in the axial direction of the developing sleeve 141. Then, image quality becomes unstable.

Figure 24:
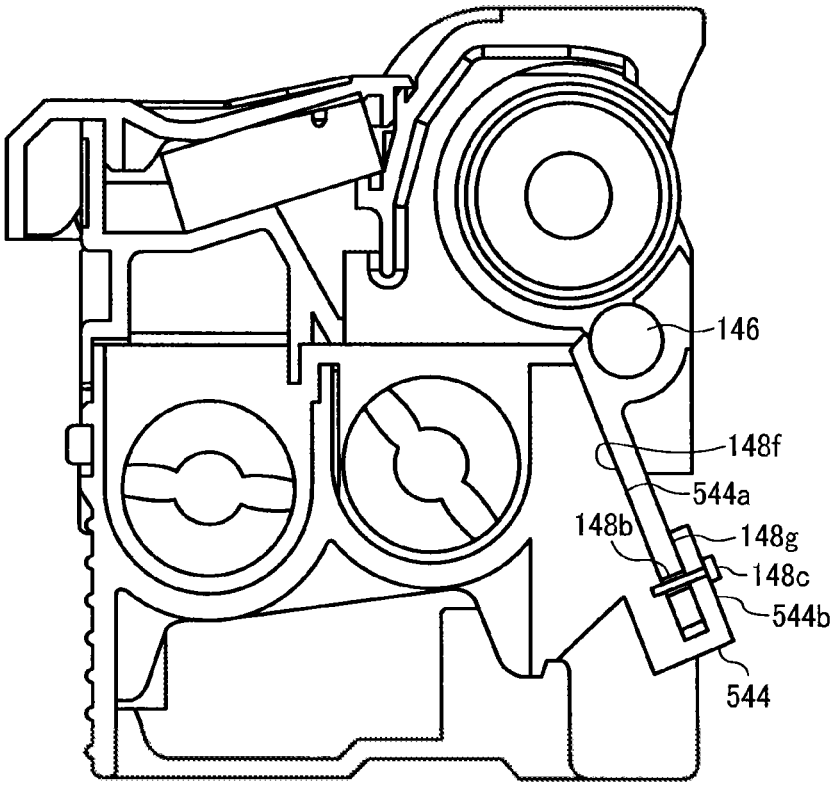
FIG. 24 is a cross-sectional view of a developing device according to a seventh variation, perpendicular to the axial direction of the developing sleeve.

FIG. 24 is a cross-sectional view of the developing device according to the seventh variation, perpendicular to the axial direction of the developing sleeve 141.

In the seventh variation, the doctor holder 148 is similar to that according to the above-described embodiment, but a holder mount of a developing device casing 544 is different. Specifically, the developing device casing 544 includes a holder mount face 544*a*, to which the attached face 148*f* of the doctor holder 148 is attached, and a retainer 544*b* facing the holder mount face 544*a*. The retainer 544*b* is united (or monolithic) with the holder mount face 144*a*. In this structure, when the attached face 148*f* of the doctor holder 148 is disposed adjoining the holder mount face 544*a* and secured thereto, the retainer 544*b* of the developing device casing 544 opposes a face 148*g* of the doctor holder 148 opposite the attached face 148*f*. In this state, the screw 148*c* is inserted from a screw hole in the retainer 544*b*, via the adjustment slot 148*b* of the doctor holder 148, into the screw hole of the holder mount face 544*a*, thereby securing the doctor holders 148 to the developing device casing 544.

When the doctor holder 148 is screwed to the developing device casing 544 according to the seventh variation, even when the doctor holder 148 receives the external force in the direction in which the attached face 148*f* of the doctor holder 148 and the holder mount face 544*a* of the draw away from each outer, the attached face 148*f* of the doctor holder 148 is prevented from parting from the holder mount face 544*a*, owing to the rigidity of the retainer 544*b*. Accordingly, even when the doctor rod 146 receives from the developer the pressing force toward downstream in the direction in which the developer passes through the doctor gap DG, the doctor holder 148 is reliably secured to the developing device casing 544, thus inhibiting fluctuations in the doctor gap DG.

The various aspects of the present specification can attain specific effects as follows.

Aspect A

Aspect A concerns a developing device that includes a developer bearer, such as the developing sleeve 141 and the magnet rollers 147 and 247, and a long developer regulator, such as the doctor rods 146 and 246, disposed facing a surface of the developer bearer, across a gap such as the doctor gap DG, and secured to a support such as the developing device casing 144. The developing device further includes a holder, such as the doctor holders 148 and 248, and a fastening, such, as the adjustment slot 148*b* and the screws 148*c*, to secure the holder to a holder mount, such as the holder mount lice 144*a*, of the support. The fastening secures the holder such that an attachment position of the holder on the holder mount is adjustable in a direction to change a size of the gap between the surface of the developer bearer and the developer regulator. In other words, the developing device includes an adjuster (such as the adjustment slot 148*b*) to adjust the attachment position of the holder in the direction in which the developer regulator laces the developer bearer. It is to be noted that, although the doctor holders 148 and 248 include the adjustment slots in the above-described embodiment and variations, the adjuster is disposed in the support (developing device casing 144) in another embodiment.

According to this aspect, the position to which the holder is attached is adjustable to change the size of the gap (the distance between the image hearer and the developer regulator), and the doctor gap DG can be adjusted with a higher degree of accuracy. Additionally, when the holder is a separate component from the developer regulator, the shape of the developer regulator imposes less limitations on the design of the structure to adjust the attachment position can be made in the holder at low cost. Accordingly, even when it is difficult for the developer regulator to have the adjustment structure for the attachment position due to the shape of the developer regulator, the doctor gap can be set with a higher degree of accuracy.

Aspect B

In Aspect A, the developer regulator extends in a direction perpendicular to a passing direction (indicated by arrow Y2) in which the developer passes through the gap and along the surface of the developer bearer (i.e., the axial direction of the developing sleeve 141). The developer regulator is disposed to allow a part of the developer borne on the surface of the developer hearer to pass through the gap, thereby adjusting the amount of the developer transported to the developing range, where the surface of the developer bearer faces the latent image bearer, such as the photoconductor drum 12.

This configuration makes it easier to adjust the amount of the developer transported to the developing range.

Aspect C.

In Aspect A or B, the developer regulator is shaped like a rod.

In the case of a rod-shaped developer regulator, generally, the manufacturing cost is lower compared with a plate-shaped developer regulator (i.e., a doctor blade). Accordingly, this aspect makes it easier to produce a lower-cost developing device.

Aspect D

In Aspect C, the rod-shaped developer regulator has one of a circular cross section and a regular polygonal cross section.

In the case of such a rod-shaped developer regulator, it is not necessary to adjust the rotation position around the axis extending in the longitudinal direction of the developer regulator in securing the developer regulator to the support. Accordingly, securing the developer regulator to the support can be easier.

Aspect F

In Aspect C or D, the holder holds the rod-shaped developer regulator not to rotate around the axis extending in the longitudinal direction of the developer regulator.

To hold a rod body rotatably, a certain amount of play is necessary at the bearing to support the rod body, and there arises a risk that such play cause the doctor gap DG to fluctuate, making the amount of developer transported to the developing range uneven. According to this aspect, since the holder holds the rod-shaped developer regulator not to rotate, such play is unnecessary. Thus, fluctuations in the doctor gap DG is reduced, thereby stabilizing the amount of the developer transported to the developing range.

Aspect F

In any one of Aspects C through E, the holder includes an upstream claw (e.g., the claw 148*e*) and a downstream claw (e.g., the claw 148*d*) facing each other in a direction perpendicular to the longitudinal direction of the rod-shaped developer regulator from both sides in that direction, and the holder holds the rod-shaped developer regulator not to cover, with the upstream claw and the downstream claw, an opposing portion of the rod-shaped developer regulator facing the surface of the developer bearer. The claw 148*d*, on the downstream side of the opposing portion in the passing direction (indicated by arrow Y2, in which the developer passes through the gap is disposed to contact a point (E), on the circumference of the rod-Shaped developer regulator, positioned downstream in the passing direction from the center (O1) of the rod-shaped developer regulator on the cross section perpendicular to the longitudinal direction of the rod-shaped developer regulator.

According to this aspect, the downstream claw inhibits the rod-shaped developer regulator from moving downstream in the passing direction of the developer, receiving the pressing, force from the developer, and the amount of developer to pass through the gap (transported to the developing range) can be stable.

Aspect G

In any one of Aspects C through F, the holder includes an upstream claw (e.g., the claw 148*e*) and a downstream claw (e.g., the claw 148*d*) facing each other in a direction perpendicular to the longitudinal direction of the rod-shaped developer regulator to pinch the doctor rod 146 from both sides in that direction, and the holder holds the rod-shaped developer regulator not to cover, with the upstream claw and the downstream claw, an opposing portion of the rod-shaped developer regulator facing the surface of the developer bearer. Additionally, as viewed from the center (O1) of the rod-shaped developer regulator on the cross section perpendicular to the longitudinal direction of the rod-shaped developer regulator, a smallest angle between the points C and D on the circumference of the rod-shaped developer regulator, to which the ends of the claws respectively contact, is smaller than 180 degrees. That is, the angle θ2 between a segment connecting the point C and the center O1 and the segment connecting the point 13 and the center O1 is smaller than 180 degrees.

With this configuration, even when an external force in the direction toward the developer bearer acts on the rod-shaped developer regulator, the claws resist the external force and inhibit the rod-shaped developer regulator from approaching the developer bearer. As a result, even when such an external three acts on the rod-shaped developer regulator, fluctuations in the doctor gap DG is restricted, and the amount of developer to pass through the doctor gap DG (transported to the developing range) can be stable.

Aspect H

In any one of Aspects A through G, the holder includes a full-circumference retainer (such as the rings 348B) to cover an entire circumference of a portion of the rod-shaped developer regulator disposed facing a non-developing range outside the developer range on the surface of the developer bearer.

With this aspect, even when the rod-shaped developer regulator is about to deform receiving the pressing force from the developer, the deformation is strongly inhibited at the position where the entire circumference of the developer-regulator is held (e.g., with the ring 348B), and the amount of developer to pass through the doctor gap DG to the developing range can be stable.

Aspect I

In Aspect H, the non-developing range is outside the surface oft developer bearer in the longitudinal direction of the rod-shaped developer regulator.

With this aspect, the full-circumference retainer, which covers, the entire circumference of the rod-shaped developer regulator, can have a thickness greater than the gap (the doctor gap DG) to increase the rigidity. As a result, deformation of the rod-shaped developer regulator is more strongly prevented, and the amount of developer to pass through the doctor gap DG (transported to the developing range) ran be more stable.

Aspect J

In any one of Aspects A through I, the holder includes at least three holder portions spaced apart in the longitudinal direction of the rod-shaped developer regulator.

When, due to the shape of the developer regulator (e.g., rod-shaped), it is difficult to make an adjustment structure (e.g., slots) to adjust the attachment position of the developer regulator on the structure supporting the developer bearer in the direction approaching and parting from the developer bearer, typically, the developer regulator deforms more easily than a plate-like developer regulator (i.e., a doctor blade). When such a developer regulator is held at two positions spaced apart from each other in the longitudinal direction thereof, there is a risk that the developer regulator deforms due to the pressure from the developer, the weight of the developer regulator, and the magnetic force. If the developer regulator deforms, the amount of developer that passes through the doctor gap DG becomes uneven in the longitudinal direction of the developer, regulator. That is, the amount of developer transported to the developing range become uneven in that direction, degrading image quality.

According to this aspect, the developer regulator is held at three or more positions spaced apart front each other in the longitudinal direction thereof, and deformation of the developer regulator is suppressed better. Accordingly, the amount of developer that passes through the doctor gap DG can be inhibited from becoming uneven in the longitudinal direction of the developer regulator, thereby alleviating the degradation of image quality.

Aspect K

In any one of Aspects A through J, the holder includes at least two holder portions (e.g., the doctor holder 148 and the holder portions 248A) spaced apart in the longitudinal direction of the rod-shaped developer regulator, and the fastening secures the holder portions to respective attachment positions on the holder mount of the support. The fastening secures each of the holder portions with the individual attachment position on the holder mount adjustably in the direction to change the size of the gap between the surface of the developer hearer and the developer bearer.

There is a case where the amount of developer transported to the developing range becomes uneven in the longitudinal direction of the developer regulator when the doctor gap DG is kept uniform in the longitudinal direction of the developer regulator. For example, in some cases, the magnetic three acting on the developer passing through the doctor gap DG is stronger in the end portions than the center portion in the longitudinal direction of the developer regulator. In this case, the amount of developer transported to the developing range is greater in the center portion than the end portions. According to this aspect, the attachment positions of the holder portions on the holder mount of the support are adjustable to intentionally deform the developer regulator so that the doctor gap DG is narrower in the center portion than the end portions in the longitudinal direction of the developer regulator. Accordingly, the amount of developer transported to the developing range can be inhibited from becoming uneven in the longitudinal direction of the developer regulator.

Aspect L

In any one of Aspects A through K, the holder includes at least two holder portions (e.g., the doctor holder 148 and the holder portions 248A) that hold positions of the rod-shaped developer regulator spaced apart in the longitudinal direction thereof, and the holder portions are coupled together. The fastening secures the holder portions to respective attachment positions on the holder mount of the support.

According to this aspect, the relative positions of the holder portions spaced apart in the longitudinal direction of the developer regulator are determined. In the configuration in which the two or more holder portions are separate from each other, it is necessary to individually adjust the attachment position of each holder portion in securing each holder portion to the support. By contrast, in this aspect, since the relative positions of the two or more holder portions are determined, it is not necessary to individually adjust the attachment positions of the holder portions. Thus, attachment work is easier.

Aspect M

In any one of Aspects A through I, the holder holds an entire length of the rod-shaped developer regulator in the longitudinal direction of the developer regulator.

Although the developer regulator is held at two or more positions spaced apart in the longitudinal direction thereof in the above-described aspect, there is a care where the developer regulator locally deforms in the portion other than the two or more positions held by the holder, receiving the pressure from the developer passing through the doctor gap DG, lithe developer regulator locally deforms, the doctor gap DG becomes uneven in the longitudinal direction of the developer regulator, and the amount of developer to pass through the doctor gap DG (transported to the developing range) becomes uneven in that direction.

According to this aspect, since the holder holds the developer regulator entirely in the longitudinal direction thereof, local deformation of the developer regulator is inhibited even if the developer regulator receives the pressure from the developer passing through the doctor gap DG. Accordingly, the amount of developer that passes through the doctor gap DG can be inhibited from becoming uneven in the longitudinal direction of the developer regulator.

Aspect N

In any one of Aspects A through M, the holder holds the developer regulator within the developer range width facing the developing range on the surface of the developer bearer.

With this aspect, since the holder holds the developer regulator at a position inside the developing range, the doctor gap DG inside the developing range width, which can affect the image quality, can be set with a high accuracy.

Aspect O

In any one of Aspects A through N, the developer bearer includes a rotatable, nonmagnetic hollow member (e.g., the developing sleeve 141) and a magnetic field generator (e.g., the magnet rollers 147 and 247), disposed inside the hollow member. The developer bearer bears, on the outer circumferential face thereof, the developer including magnetic carrier and toner with effects of the magnetic force exerted by the magnetic field generator and transports the developer by rotation of the hollow member. Additionally, the developer regulator is made of a magnetic material.

This configuration enhances the magnetic flux density (in the direction normal to the surface of the developer bearer) in the doctor gap DG, thereby reducing the amount of developer to pass through the doctor gap DG (transported to the developing range). Reducing the amount of developer to pass through the doctor gap DG is advantageous in that the doctor gap DG can, be wider relative to the target amount of developer to pass through the doctor gap DG (to the developing range). As the doctor gap DG becomes wider, fluctuations in the amount of developer that passes through the doctor gap DG, corresponding to deviations of the doctor gap DG (distance from the developing sleeve 141 to the doctor rod 146) become smaller. Accordingly, this aspect suppresses the fluctuation in the amount of developer transported to the developing range due to the deviations of the doctor gap DG. Additionally, as the doctor gap DG becomes wider, the possibility of clogging of the doctor gap DG with foreign substances becomes smaller. Thus, image failure such as white streaks resulting from the foreign substance stuck in the doctor gap DG can be inhibited.

Aspect P

In Aspect O, the magnetic field generator has at least a regulation pole (e.g., the regulation pole N2), disposed closest to the gap among the multiple magnetic poles of the magnetic field generator, and a developer scooping pole (e.g., the pole S3 for releasing and scooping) to exert magnetic force to scoop the developer contained in the developer container onto the outer circumferential face of the hollow member, disposed upstream from the regulation pole in the direction of rotation of the hollow member.

In this magnetic pole arrangement, the developer scooping pole exerts the force to scoop the developer onto the developer bearer, and, the regulation pole exerts the force to transport the developer through the doctor gap DG. Accordingly, the magnetic force of the regulation pole can be lower compared with a magnetic pole arrangement in which the force to scoop the developer and the force to transport the developer are attained by a single magnetic pole. Consequently, even in a configuration in which the developer regulator is made of a magnetic material, the developer regulator is less easily deformed by the magnetic force. Accordingly, the amount of developer transported to the developing range can be stabilized easily, and unevenness in the developer conveyance in the longitudinal direction of the developer regulator is inhibited easily.

Aspect Q

In any one of Aspects A through N, the developer bearer includes a rotatable, nonmagnetic hollow member and a magnetic field generator, disposed inside the hollow member. The developer bearer bears, on the outer circumferential face thereof, the developer including magnetic carrier and toner with effects of the magnetic force exerted by the magnetic field generator and transports the developer by rotation of the hollow member. Additionally, the developer regulator is made of a nonmagnetic material.

This aspect can inhibit the developer regulator from deforming due to the magnetic force exerted by the magnetic field generator. Accordingly, the amount of developer transported to the developing range can be stabilized easily, and unevenness in the developer conveyance in the longitudinal direction of the developer regulator is inhibited easily.

Aspect R

In Aspect O or Q, the magnetic field generator has at least a scooping and regulating pole disposed close to the gap, and the scooping and regulating pole exerts a magnetic force for scooping and regulating the developer on the outer circumferential face of the hollow member.

With this aspect, while the developer is scooped onto the developing sleeve 141 and passes through the doctor gap DG, no polarity change point is present. Accordingly, when a large amount of developer scooped onto the developer bearer (before regulated in the doctor gap DG) passes by the polarity change points, the developer is prevented from being largely moved with the magnetic force under a strong restraint. Accordingly, friction between the carrier and the toner is reduced, thereby reducing the stress given on the developer. Accordingly, the degradation of the developer can be inhibited.

Aspect S

In an image forming apparatus that forms images by developing, with the developing device 14, a latent image on the latent image bearer such as the photoconductor drum 12 and transferring the image onto a recording medium such as the sheet P, the developing device according to any one of Aspects A through R is used.

Accordingly, even when it is difficult for the developer regulator to have the adjustment structure for the attachment position due to the shape of the developer regulator, the doctor gap can be set with a higher degree of accuracy.

Numerous additional modifications and variations are possible in light of the above teachings. It is, therefore to be understood that, within the scope of the appended claims, the disclosure of this patent specification may be practiced otherwise than as specifically described herein.

What is claimed is:

1. A developing device comprising:

a developer bearer disposed facing a latent image bearer in a developing range, the developer bearer to transport developer by rotation;

a support to support the developer bearer and including a holder mount;

a rod-shaped developer regulator disposed facing a surface of the developer bearer across a gap, the developer regulator extending in an axial direction of the developer bearer; and a holder secured to the holder mount of the support to hold the developer regulator, wherein the holder holds an entire circumference of the developer regulator at a position outside the developing range, and includes a contact protrusion extending for a substantially entire longitudinal length of the developer regulator to contact the developer regulator throughout the entire developing range.

2. The developing device according to claim 1, wherein the holder holds the entire circumference of the developer regulator at a position outside the developer bearer in the axial direction of the developer bearer.

3. The developing device according to claim 1, wherein the developer bearer includes a rotatable, nonmagnetic hollow sleeve to transport the developer by rotation, and a magnetic field generator disposed inside the hollow sleeve to exert a magnetic force to attract the developer to an outer circumferential surface of the hollow sleeve of the developer bearer, wherein the developer includes magnetic carrier and toner, and wherein the developer regulator is made of a magnetic material.

4. The developing device according to claim 3, wherein the magnetic field generator has at least a regulation pole disposed close to the gap and a developer scooping pole disposed upstream from the regulation pole in a direction of rotation of the hollow sleeve to exert a magnetic force to scoop the developer onto the outer circumferential surface of the hollow sleeve of the developer bearer.

* * * * *